US007222572B2

(12) United States Patent
Mochizuki

(10) Patent No.: US 7,222,572 B2
(45) Date of Patent: May 29, 2007

(54) PRINTING APPARATUS, PRINTING METHOD, AND PROGRAM

(75) Inventor: Yoshiaki Mochizuki, Tokyo (JP)

(73) Assignee: Casio Computer Co., Ltd., Tokyo (JP)

( * ) Notice: Subject to any disclaimer, the term of this patent is extended or adjusted under 35 U.S.C. 154(b) by 0 days.

(21) Appl. No.: 10/512,605

(22) PCT Filed: Apr. 28, 2003

(86) PCT No.: PCT/JP03/05444

§ 371 (c)(1),
(2), (4) Date: Oct. 25, 2004

(87) PCT Pub. No.: WO03/091033

PCT Pub. Date: Nov. 6, 2003

(65) Prior Publication Data

US 2005/0169684 A1 Aug. 4, 2005

(30) Foreign Application Priority Data

Apr. 26, 2002 (JP) ..... 2002-127123
Jun. 28, 2002 (JP) ..... 2002-189724

(51) Int. Cl.
*B41F 33/00* (2006.01)

(52) U.S. Cl. ..... 101/483; 101/38.1; 101/485; 101/486

(58) Field of Classification Search ..... 101/38.1, 101/35, 485, 486; 400/70, 61; 347/171
See application file for complete search history.

(56) References Cited

U.S. PATENT DOCUMENTS 4,277,186 A 7/1981 Takahashi
4,349,828 A 9/1982 Fischbeck et al.
5,317,337 A * 5/1994 Ewaldt ..... 347/2
5,532,724 A 7/1996 Inagaki et al.
5,738,008 A * 4/1998 Freund ..... 101/35
5,947,614 A 9/1999 Shoji et al.
6,019,151 A * 2/2000 Wen et al. ..... 156/387
6,148,722 A 11/2000 Hagstrom
6,174,096 B1 * 1/2001 Harris ..... 400/236.2
6,202,550 B1 * 3/2001 Lee et al. ..... 101/38.1

(Continued)

FOREIGN PATENT DOCUMENTS

EP 0 585 852 A2 3/1994

(Continued)

OTHER PUBLICATIONS

Chinese Office Action issued in counterpart Chinese application No. 038093669, dated Sep. 22, 2006.

*Primary Examiner*—Ren Yan
*Assistant Examiner*—Matthew Marini
(74) *Attorney, Agent, or Firm*—Frishauf, Holtz, Goodman & Chick, P.C.

(57) ABSTRACT

This printing apparatus comprises a support tray provided with a rotatable base, and an optical disk as a printing object is mounted on the rotatable base. A control section of the printing apparatus selectively operates rotation drive means for driving the rotatable base to be rotated and print means for printing predetermined data on a surface of the optical disk, thereby executing printing to a plurality of portions of the optical disk.

7 Claims, 25 Drawing Sheets

U.S. PATENT DOCUMENTS

| | | | | |
|---|---|---|---|---|
| 6,270,176 | B1 * | 8/2001 | Kahle | 347/2 |
| 6,302,601 | B1 * | 10/2001 | Hagstrom et al. | 400/283 |
| 6,827,509 | B2 * | 12/2004 | Suden et al. | 400/120.01 |
| 6,869,236 | B2 * | 3/2005 | Motoyanagi | 400/70 |
| 2002/0122378 | A1 * | 9/2002 | Kubo | 369/273 |
| 2005/0220522 | A1 | 10/2005 | Mochizuki et al. | |

FOREIGN PATENT DOCUMENTS

| | | | |
|---|---|---|---|
| EP | 1 018 433 | A1 | 7/2000 |
| EP | 1 108 550 | A1 | 6/2001 |
| GB | 2 353 975 | A | 3/2001 |
| JP | 0585852 | A2 * | 8/1993 |
| JP | 05-238005 | A | 9/1993 |

* cited by examiner

Fig.25

| DATA / MEDIUM | DATA 1 | DATA 2 | DATA 3 |
|---|---|---|---|
| LARGE DISK | 0 | L1/2 | L1 |
| SMALL DISK | a | L2/2 | L2 |
| CARD TYPE | b | L3/2 | L3 |

PRINTING APPARATUS, PRINTING METHOD, AND PROGRAM

This application is a U.S. National Phase Application under 35 USC 371 of International Application PCT/JP03/05444 filed Apr. 28, 2003.

TECHNICAL FIELD

The present invention relates to a printing apparatus and printing method for printing information such as a title and the like of data recorded on a recording medium on the surface of the recording medium such as an optical disk and the like as a printing object.

BACKGROUND ART

Conventionally, the applicant of the present application has proposed printing apparatuses that print a title of an optical disk such as CD-R (Compact Disk-Recordable) on its surface, and has sold such printing apparatuses in Japan.

This type of printing apparatus includes a tray that supports a disk and a printer mechanism that performs printing to the disk supported by the tray. The tray is moved to an external section of a main body of the printing apparatus by an eject operation. The printer mechanism performs thermal transfer printing to an optical disk, which is supported on the tray provided at a predetermined position in the main body of the printing apparatus and which is in a stationary state, using an ink ribbon by a thermal head that moves back and forth.

In the aforementioned printer mechanism, printing is performed to the surface of the optical disk in one rectangular range, which corresponds to an effective print width that the thermal head has and a distance where the thermal head moves and scans, by one print operation.

Accordingly, in a case where a user desires to provide printing to a plurality of portions of the surface (label surface) of the optical disk by the printer mechanism, the user must carry out the following operations. Namely, the user once pushes the tray out of the printing apparatus by the eject operation after printing one portion. Then, in order that an area, which is opposite to a print area at the first print around a hole of the disk, is made correspond to the position of the printer mechanism, the user rotates the optical disk on the tray at 180° manually to be reset and turns the tray to the main body of the printing apparatus. Then, printing is performed to the different portion by a second print operation of the printer mechanism.

This printing apparatus is one that performs printing to a predetermined area on the surface of the optical disk in a state that the optical disk is stood still. Since the area printable by one printing operation is a limited size against the entire surface of the optical disk, there is a case that the user desires to expand the print area to provide printing to a plurality of portions.

In this case, according to this type of printing apparatus, the tray must be once ejected to change the placement of optical disk to perform printing, repeatedly.

In other words, according to this type of printing apparatus, every time when one print processing ends, the tray must be ejected to the external section of the printing apparatus that can attach/detach the optical disk thereto/therefrom. Moreover, such a complicated task is needed that the positioning is performed on the tray to change the placement of optical disk manually and the tray is turned to the main body of printing apparatus to restart the printing operation. For this reason, efficiency of printing work will be reduced.

Further, there conventionally have been proposed another type of printing apparatuses that print a title on the optical disk, such as one disclosed in Unexamined Japanese Patent Application KOKAI Publication No. H5-238005. Specifically, such a printing apparatus is an ink jet printing apparatus that moves a print head thereof in a radial direction of the optical disk while rotating the optical disk thereby to perform printing on the optical disk in a spiral manner, or that drives a print head thereof which is provided to be extended in a radial direction of the optical disk as rotating the optical disk and thereby performs printing.

Since this type of printing apparatus performs printing in a spiral manner by rotating an optical disk and moving a print head thereof in the radial direction of the optical disk, the rotation of the optical disk and the movement of the print head need to be controlled together, resulting in a problem that such a control is complicated.

Further, this type of printing apparatus is one that performs printing by driving the print head that extends in the radial direction of the optical disk and by once rotating the optical disk. According to this printing apparatus, the rotational speed at a position close to the center of the optical disk is different from the rotation speed at a position away from the center. Since a moving speed to the print head is low at the position close to the center, a print result with high density is obtained. Contrary to this, the moving speed to the print head is high at the position away from the center, so that a print result with low density is obtained. For this reason, it is necessary to perform specific print control to equalize print density at the position in the radial direction of the optical disk, resulting in considerable complicated control.

Moreover, since it is necessary to perform the rotational drive of optical disk and the drive of print head at the same time, a drive power supply must be enlarged.

DISCLOSURE OF INVENTION

An object of the present invention is to provide a printing apparatus and a printing method capable of performing printing to a plurality of portions on a surface of a printing object efficiently with a simple apparatus configuration.

Another object of the present invention is to provide a printing apparatus manufacturable with a small-sized power supply without need of complicated print control and a printing method.

Further another object of the present invention is to provide a printing apparatus and a printing method applicable to a plurality of kinds of printing objects each having a different size with a simple apparatus configuration.

In order to attain the above object, a printing apparatus according to a first aspect of the present invention comprising support means, including a rotatable base, for supporting a data recordable recording medium; rotation drive means for driving the rotatable base to be rotated; print means for performing printing to the recording medium supported by the support means; and control means for controlling the operations of the rotation drive means and the print means, wherein the control means selectively operates the rotation drive means and the print means.

According to this configuration, the apparatus can be configured simply and at low cost. Moreover, it is possible to perform printing to the plurality of portions on the surface of the printing object with a simple operation as mounting the printing object on the rotatable base. Moreover, since the rotation drive means for driving the rotatable base and the print means for printing to the printing object supported by the support means is selectively operated, the drive source of the printing apparatus is configured in a small scale, so that the printing apparatus can be manufactured at low cost.

In the above configuration, the print means may include a print head that moves as pressing against the recording medium supported by the support means through an ink ribbon to perform thermal transfer printing, the support means is movable to a position where the recording medium is attached/detached to/from the rotatable base and a position where printing is performed to the recording medium, which is supported by the rotatable base, by the print means, and the rotatable base may include a cushion member, which abuts against the recording medium, and engaging means, which engages with the recording medium, on a surface where the recording medium is mounted.

According to this configuration, since the cushion member is provided on the surface of the rotatable base where the printing object is mounted, the cushion member is equally elastically deformed and the print head comes in contact with the surface of the printing object equally when the print head presses against the printing object. Accordingly, satisfactory printing can be performed. Moreover, since the rotatable base includes engaging means for engaging the printing object, the printing object is engaged with the rotatable base without fail to make it possible to prevent the printing object from being detached even if the printing apparatus is used uprightly.

In the above configuration, the cushion member may be provided at a position on the rotatable base subjected to pressure by the print head at the time of printing to the recording medium in a range corresponding to a width of the print head and a length where the print head presses against the recording medium and moves.

According to this configuration, the cushion member is provided at the position on the rotatable base subjected to pressure by the print head at the time of printing to the recording medium in the range corresponding to the width of the print head and the length where the print head presses against the recording medium and moves. Accordingly, when the print head presses against the printing object, the cushion member is more equally elastically deformed and the print head comes in contact with the surface of the printing object equally, so that more satisfactory printing can be performed.

The print means may include a print head that moves as pressing against the recording medium supported by the support means through an ink ribbon to perform thermal transfer printing. The support means may include a support base, which supports the rotatable base to be rotatable around a rotation shaft and to be rotatable in an axial direction of the rotation shaft, and urging means for urging the rotatable base to the support base. One of opposing surfaces of the support base and the rotatable base may include convex portions, which project from the one opposing surface and which slide in contact with the other opposing surface opposing to the one opposing surface during the rotating operation of the rotatable base by the rotation drive means, around the rotation shaft. The other opposing surface may include concave portions, into which the convex portions are fit at the print operating time by the print means, around the rotation shaft.

According to this configuration, when the rotational base rotates at a non-print operating time, the rotatable base contacts the convex portions and rotates smoothly, and the convex portions fit into the concave portions by urging means at the printing time, thereby the rotatable base is stably supported at the position with a predetermined rotation angle.

At least one of opposing surfaces of the support base and the rotatable base may include a member having a thickness smaller than a projection height of the convex portion, a cushion property, and a friction property.

According to this configuration, when the convex portions fit into the concave portions, the rotatable base is adhered to the support base through the member having the cushion property and the friction property, and the rotatable base is thereby stably supported at the position with the predetermined rotation angle.

The print means may include a print head that moves as pressing against the recording medium supported by the support means through an ink ribbon to perform thermal transfer printing. The support means is movable to a position where the recording medium is attached/detached to/from the rotatable base and a position where printing is performed to the recording medium, which is supported by the rotatable base, by the print means. Either one of opposing surfaces of the support base and the rotatable base opposing to each other may include convex portions, which project from the one opposing surface and which abut against other opposing surface opposing to the one opposing surface, at a portion subjected to pressure by the print head.

According to this configuration, since either one of opposing surfaces of the support base and the rotatable base opposing to each other may include convex portions, which project from the one opposing surface and which abut against other opposing surface opposing to the one opposing surface, at a portion subjected to pressure by the print head, the rotatable base can receive the pressure of the print head stably and equally.

A rotating direction of the rotatable base driven to be rotated by the rotation drive means and a moving direction of the print head may be opposite to each other in the direction at a print portion.

According to this configuration, since the rotating direction of the rotatable base driven to be rotated by the rotation drive means and the moving direction of the print head may be opposite to each other in the direction at a print portion, no backlash occurs in the rotation drive means for driving the rotatable base to be rotated. Accordingly, the rotational base is prevented from being slightly rotated at the print operating time, so that satisfactory printing can be performed.

The rotation drive means may include a drive motor and a gear train having a worm gear that transmits power of the drive motor to the rotatable base.

According to this configuration, the rotation drive means includes the drive motor and the gear train having the worm gear that transmits power of the drive motor to the rotatable base, and this eliminates the accidental rotation of the rotatable base at the print head moving time. Accordingly, the rotatable base is maintained in a fixed state without fail, so that satisfactory printing can be performed.

In the above configuration, the printing apparatus may further comprise detecting means for detecting kinds of the data recordable recording media, which are attached to the support means and which have a different size and storing means for storing information, in advance, on print areas which are respectively set to the plurality of recording media each having a different size. The control means may read information on each print area corresponding to the kind of each of the recording media detected by the detecting means from the storing means, and drive the print means based on the information to perform printing to the print area of each of the recording media attached to the support means.

In the above configuration, any one of means, which is operated by the control means, for moving the print means to at least the support means to perform printing in the print area and means for moving the support means to the print means, or means for selectively driving a plurality of printing elements included in the print head may be provided.

In order to attain the above object, the printing apparatus according to the second aspect of the present invention is a printing apparatus, which performs printing to a plurality of data recordable recording media each having a different size, comprising detecting means for detecting kinds of the data recordable recording media, which are attached to the printing apparatus; storing means for storing information, in advance, on print areas which are respectively set to the plurality of recording media: and control means for reading information on each print area corresponding to the kind of each of the recording media detected by the detecting means from the storing means to drive the printing apparatus based on the information to perform printing to the print area of each of the recording media attached to the print printing apparatus.

In the above configuration, the printing apparatus may further comprise support means for supporting one of the plurality of recording media; and printing means, having a print head, for driving the print head to perform printing to the recording medium supported by the support means. Any one of means, which is operated by the control means, for moving the print means to at least the support means to perform printing in the print area and means for moving the support means to the print means, or means for selectively driving a plurality of printing elements included in the print head may be provided.

In the above configuration, the printing apparatus may further comprise detecting means for detecting kinds of predetermined print objects supported by the support means. The support means may support a first print object and a second print object selectively. The control means may selectively operate the rotation drive means and the print means when the detecting means detects the first print object, and may stop operating the rotation drive means and operate only the print means when the detecting means detects the second print object.

In the above configuration, the first print object may be a disk-like data-recordable recording medium having a predetermined diameter, and the second print object may be a rectangular paper material whose one side has substantially a same length as the predetermined diameter.

In order to attain the above object, a printing method according to a third aspect of the present invention comprises the steps of supporting data recordable recording media in a printing apparatus; printing predetermined data to the recording media supported in the supporting step; and rotating the recording medium up to a predetermined angle in the printing apparatus, wherein the printing step and the rotating step are selectively executed to perform printing to a plurality of portions of the recording media.

In the above method, the printing method may further comprise the steps of detecting kinds of the data recordable recording media, which are supported by the printing apparatus and which have a different size; storing information, in advance, on print areas which are respectively set to the recording media each having a different size: and reading information on each print area corresponding to the kind of each of the recording media detected in the detecting step from information stored in the storing step, wherein the printing step drives the printing apparatus to perform printing to a predetermined print area of the recording medium based on the information read in the reading step.

Moreover, the printing step may include at least any one of the step of moving print means to at least support means for supporting the recording media, the step of moving the support means to the print means, or the step of selectively driving a plurality of printing elements included in a print head.

In order to attain the above object, a printing method according to a third aspect of the present invention controls a computer to selectively execute a step of printing predetermined print data to a data recordable recording medium which is supported in a printing apparatus, and a step of rotating the recording medium up to a predetermined angle in the printing apparatus, thereby to perform printing to a plurality of portions of the recording medium.

BRIEF DESCRIPTION OF DRAWINGS

Embodiments of the present invention will be explained as follows with reference to the following drawings.

FIG. 25 is an explanatory view of print area position information;

BEST MODE FOR CARRYING OUT THE INVENTION (First Embodiment)

Figure 1:
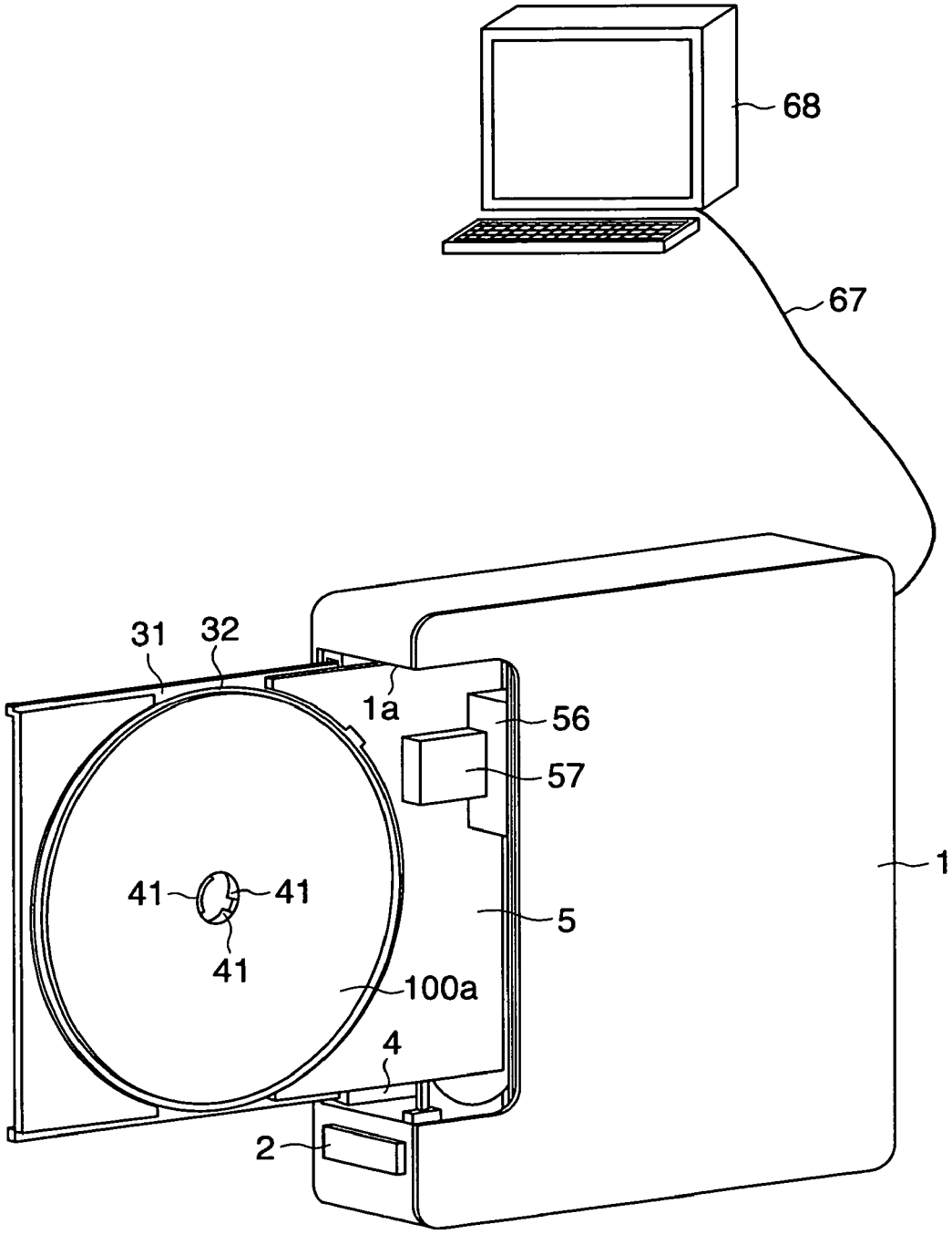
FIG. 1 is a perspective view showing a state that a printing apparatus according to a first embodiment of the present invention is used.
Figure 2:
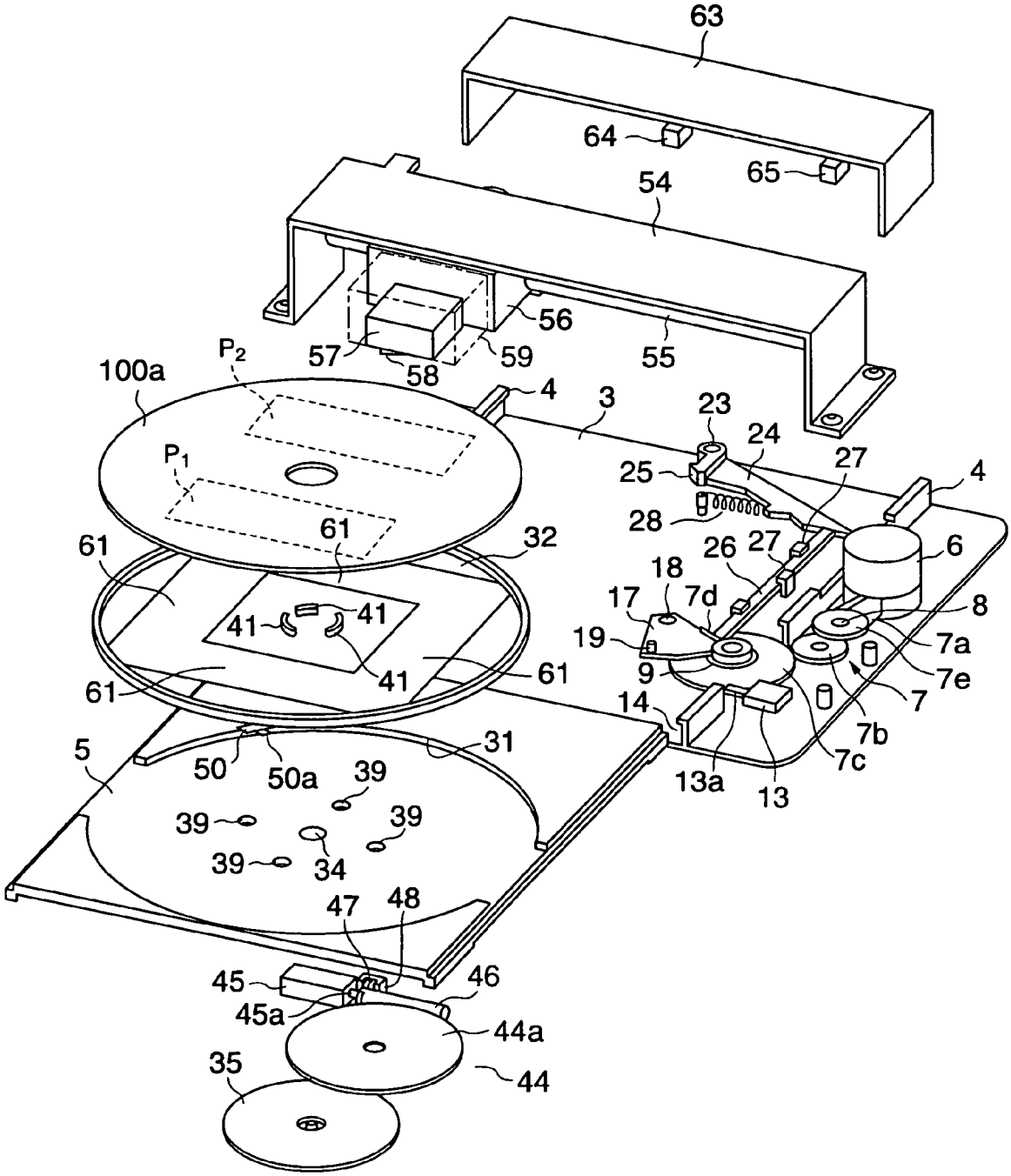
FIG. 2 is an exploded perspective view showing an internal mechanism of the printing apparatus of FIG. 1.
Figure 3:
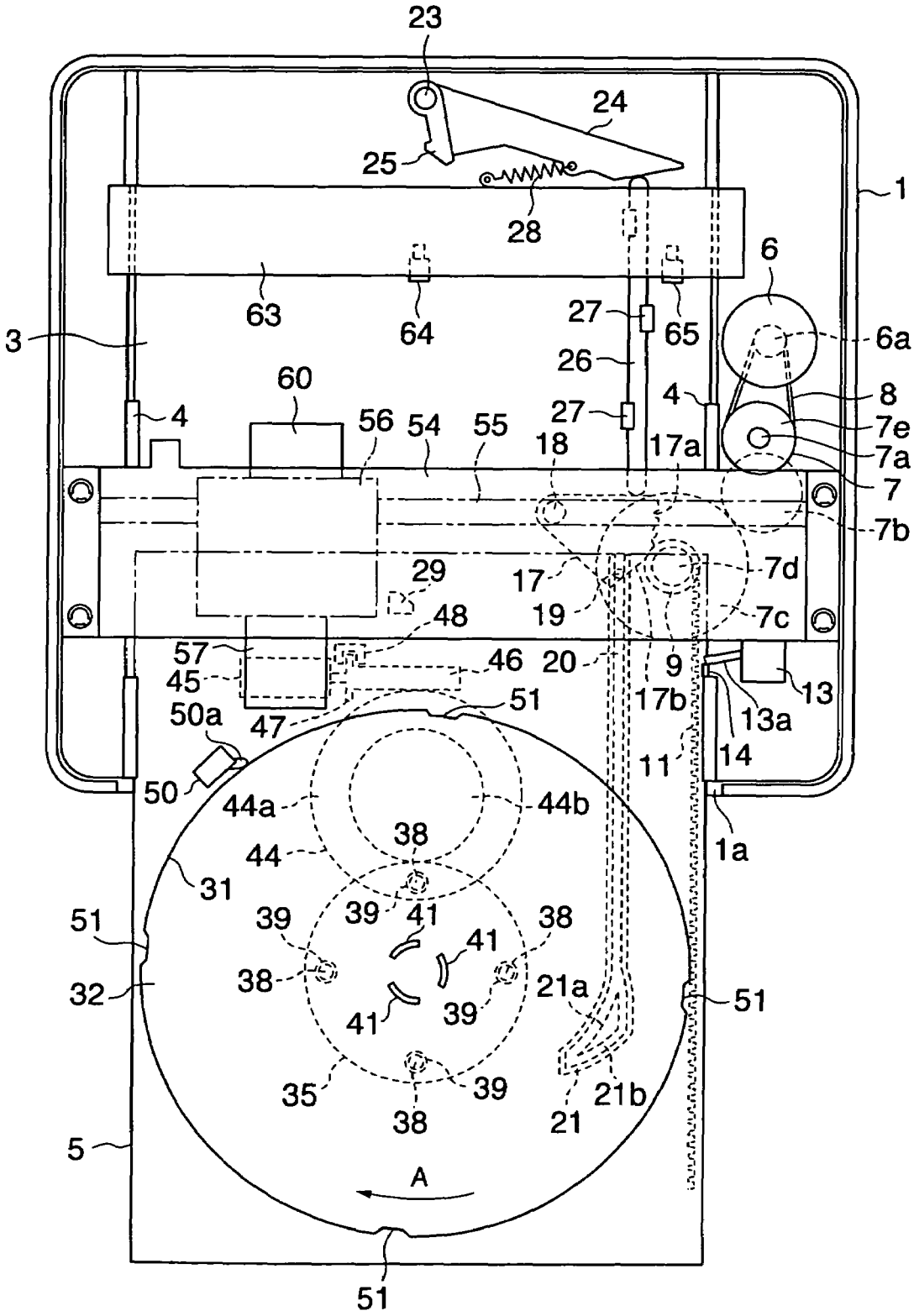
FIG. 3 is a plane structural view at the time of ejecting a support tray of the printing apparatus of FIG. 1.
Figure 4:
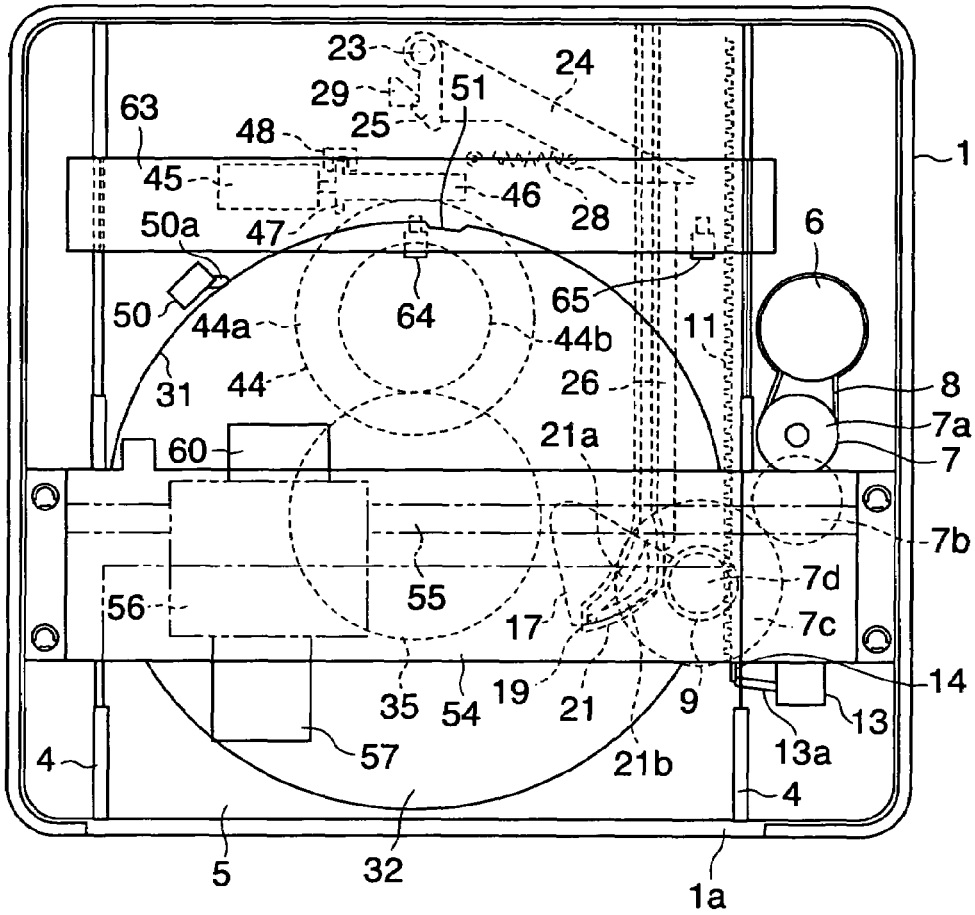
FIG. 4 is a plane structural view at the time of inserting a support tray of the printing apparatus of FIG. 1.

FIG. 1 is a perspective view of the entirety of a printing apparatus according to a first embodiment; FIG. 2 is an exploded perspective view of the main parts of the printing apparatus, and FIGS. 3 and 4 are views each showing a plane structural view of the main parts.

Additionally, the printing apparatus according to this embodiment can be used both horizontally and vertically. FIGS. 3 and 4 are plane views when the printing apparatus is placed horizontally. When the printing apparatus is placed vertically as shown in FIG. 1, a right side surface or a left side surface of a case 1 corresponds to a bottom surface in FIGS. 3 and 4.

The printing apparatus of this embodiment includes a tray mechanism that supports an optical disk and a printer mechanism that performs printing (label printing) to a surface (label surface) of the optical disk supported by the tray mechanism. This printing apparatus further includes an eject function of ejecting the tray mechanism to the external section of the apparatus main body, a rotation function of rotating the optical disk supported by the tray mechanism, and a thermal transfer print function of performing printing to the label surface of the optical disk using an ink ribbon.

An explanation will be first given of the structure of the main body of the printing apparatus and the structure of the tray mechanism.

This printing apparatus includes a rectangular box-shape case 1 and an opening 1*a* is formed on a front surface of this case 1. Then, an eject switch 2 is formed at a front surface of the case 1, and a base 3 shown in FIG. 2 is fixed to an interior of the case 1.

As shown in FIG. 2, a pair of guide rails 4, which extend in parallel to be spaced to each other, is formed on an upper surface of the base 3, and a support tray 5 as a support base is slidably attached between these guide rails 4. The support tray 5 passes through the opening 1*a*, and slidably moves between the internal section of the case 1 and the external section thereof. Additionally, this support tray 5 is supported to have a fixed space between the base 3 and the support tray 5.

At one side portion of an upper surface of the base 3, there are provided a drive motor (DC motor) 6 for a tray and a gear train 7 composed of a plurality of first to fourth gears 7*a* to 7*d* driven by the drive motor 6. A pulley 7*e* is provided coaxially with the first gear 7*a* of the gear train 7, and the pulley 7*e* is coupled to a pulley 6*a* provided at an output shaft of the drive motor 6 through a belt 8. Moreover, the second gear 7*b* and the gear 7*c* mesh with the first gear 7*a* and the third gear 7*c*, sequentially, so that rotational power of the drive motor 6 is transmitted to the third gear 7*c*.

The third gear 7*c* and fourth gear 7*d* are coupled to each other through a lug mechanism (intermittent gear mechanism). When the third gear 7*c* rotates by an angle of, for example, 135° in a forward direction, rotational power of the third gear 7*c* is transmitted to the fourth gear 7*d*. Moreover, when the third gear 7*c* reversely rotates by an angle of 135° from this state, rotational power of the third gear 7*c* is transmitted to the fourth gear 7*d*.

A rack 11 is provided in the internal portion of the lower surface side of the support tray 5. Here, the lower surface side is the back surface side of the support tray, i.e., the surface side opposite to the front surface to which the optical disk is mounted. The fourth gear 7*d* meshes with the rack 11. By this mesh, the support tray 5 moves in the back and forth directions of the case 1 in accordance with the forward-reversal rotation of the fourth gear 7*d* to be displayed to an eject position (FIG. 3), which projects into the external section of the case 1, and a print position (FIG. 4), which is placed in the internal portion of the case 1.

Figure 7:
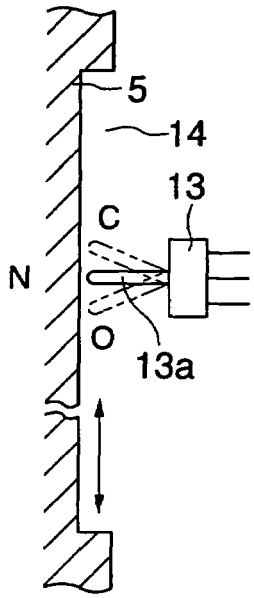
FIG. 7 is a structural view showing a tray moving position detection switch in the printing apparatus of FIG. 1.

In the case 1, there is provided a tray position detection switch 13 to be opposed to one side portion of the support tray 5. The detection switch 13 has a lever 13*a*. The lever 13*a* is engaged with a concave groove 14 formed on the side surface of the support tray 5 along its longitudinal direction. In accordance with the operation of the support tray 5 in the back and forth directions, the lever 13*a* is displaced to a neutral position N, an open position O, and a close position C as shown in FIG. 7.

Moreover, in the case 1, there is provided an actuation gear 17 corresponding to the fourth gear 7*d*. The actuation gear 17 has a fan shape and rotates with a support shaft 18 as a fulcrum. A first half section of its periphery is a teeth portion 17*a* in which teeth are arranged and a second half section thereof is a tooth omitting portion 17*b* in which teeth are omitted.

A small gear 9 is provided to the third gear 7*c* of the gear train 7 in a body, and the teeth portion 17*a* meshes with the small gear 9 in accordance with the rotation of the actuation gear 17.

A pin 19 is attached to a plate surface of the actuation gear 17 to be adjacent to the tooth omitting portion 17*b*. On a lower surface of the support tray 5, there is formed a guide groove 20 that extends along the back and forth direction of the tray 5. The pin 19 is slidably fit into the guide groove 20. In accordance with the movement of the support tray 5 in the back and forth directions thereof, the pin 19 relatively moves along the guide groove 20.

At an end portion of the top end side of the guide groove 20, there is formed a circular path 21 having an outward path 21*a* and a backward path 21*b*. In accordance with the backward movement of support tray 5, the pin 19 enters the backward path 21*b* from the guide groove 20.

At an inner portion of the back side of the case 1, there is provided a hook lever 24 that rotates with a support shaft 23 as a fulcrum. The hook lever 24 has a hook portion 25. Moreover, an actuation rod 26 is provided between the end portion of the top end side of the hook lever 24 and one side surface of the actuation gear 17.

The actuation rod 26 is supported to be slidable along the back and forth directions of the case 1 through a plurality of guide pieces 27 provided to the base 3, and the end portion of one side surface of the actuation rod 26 abuts against one side surface of the actuation gear 17. Moreover, the hook lever 24 is elastically urged clockwise in the figure by a spring 28, and the hook lever 24 elastically abuts against the end portion of the other end side of the actuation rod 26 by this urging force. At a lower surface of the back side of the support tray 5, there is provided a hook receiver 29 which is engageable with the hook portion 25, to correspond to the hook portion 25.

On the upper surface of the support tray 5, a disk-like concave portion 31 is formed. The upper surface is the surface to which the optical disk is mounted. In the concave portion 31, a rotatable base 32 is formed, and the rotatable base 32 and support tray 5 forms support means for supporting a printing object.

Figure 6A:
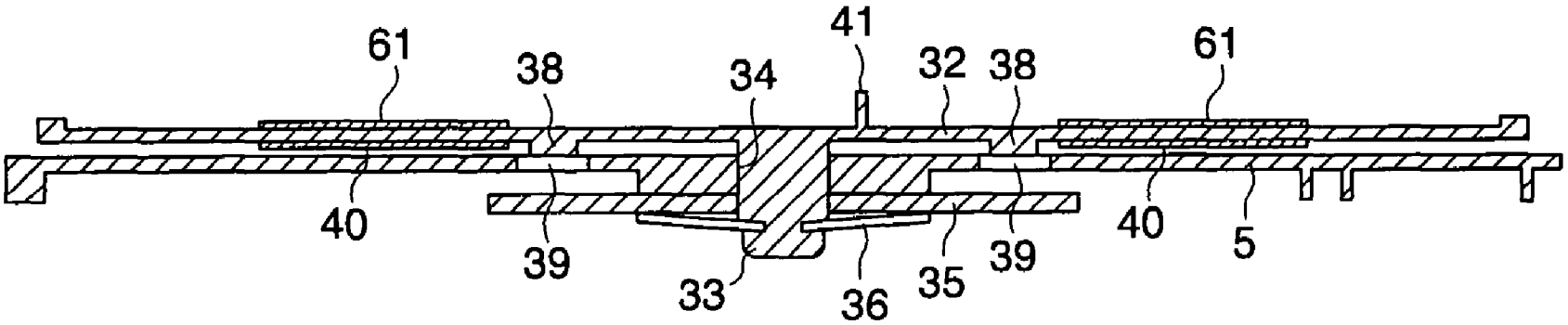
FIGS. 6A and 6B are cross-sectional views each showing a support tray and a rotatable base in the printing apparatus of FIG. 1.

The rotatable base 32 has a rotating shaft 33 in a body at the central portion of the lower surface as shown in FIG. 6. The rotating shaft 33 is rotatably inserted into a fitting hole 34 formed on the support tray 5. A gear 35 is attached to an end portion outer periphery on the inserting side to be unrotatable and slidable in an axial direction.

Moreover, a belleville-spring 36 is attached to the end portion of the rotating shaft 33 at the lower surface side of the gear 35. The periphery portion of the belleville-spring 36 elastically abuts against the lower surface of the gear 35. Moreover, the rotatable base 32 is elastically urged to the downward support tray 5 by the belleville-spring 36.

On the lower surface of the rotatable base 32, a plurality of convex portions 38 is formed to be projected with equal intervals on a circumference around the rotating shaft 33. On the support tray 5, there is a plurality of transparent hole-like concave portions 39 corresponding to the respective convex portions 38. Namely, when the convex portions 38 and the concave portions 39 face each other, respectively, the convex portions 38 fall in the concave portions 39 to be engaged with each other, respectively.

A friction sheet 40, which is made of high cushioning and friction material such as rubber and has a low thickness, that is, lower than the projection height of the convex 38, is adhered to the lower surface of the rotatable base 31, which is the portion of the outside area of the convex portion 38. At the central portion of the upper surface of the rotatable base 32, there is formed a plurality of elastically deformable projection pieces 41 to be equally positioned on the same circumference to be projected. The projection pieces 41 are used as engaging means for engaging a printing object and are arc-shaped seeing from the plane.

At the lower surface of the rotatable base 32, there are provided a gear 44 and a drive motor 45 for a rotatable base. The gear 44 has a large gear 44*a* and a small gear 44*b* in a body. A worm gear 46 is attached to a rotating shaft 45*a* of the drive motor (DC motor) 45. The worm gear 46 meshes with the large gear 44*a* of the gear 44. Moreover, the small gear 44*b* of the gear 44 meshes with the gear 35, and the rotational power of the drive motor 45 is transmitted to the rotatable base 32 through the worm gear 46, gear 44, and gear 35. Moreover, a disk 47 in which a plurality of slits are formed around its circumference is attached to the rotating shaft 45*a* . An encoder 48 which is formed by disposing a light emitting element and a light receiving element so as to sandwich the disk 47 therebetween is provided to the rotating shaft 45*a*.

A rotation position detection switch 50 is provided at the outside of a part of the inner periphery of the concave portion 31 formed on the upper surface of the support tray 5. The rotation position detection switch 50 has an actuator 50*a* that elastically projects. The actuator 50*a* elastically abuts against the outer peripheral surface of the rotatable base 32. On the outer peripheral surface of the rotatable base 32, four concave portions 51 are formed at 90 degrees intervals. The concave 51 faces the actuator 50*a* according to the rotation of the rotatable base 32. The actuator 50*a* falls in the concave portion 51 at the facing position, so that the rotation position of the rotatable base 32 is detected.

A cushion sheet 61, which is formed of elastic material with excellent cushion and adherence, is adhered to the upper surface of the rotatable base 32 to serve as a placing surface for an optical disk 100*a* to correspond to the print position of the printer mechanism that is subjected to pressure from a thermal head 58 at a printing time. In this printing apparatus, after the end of one print operation by the printer mechanism, the rotation base rotates clockwise every 90° or 180° and stops, and printing is performed to the optical disk 100*a* at each stopped position. For this reason, the cushion sheet 61 is formed to be square-frame shaped in such a manner to surround the center of the rotatable base 32 in order to correspond to four print areas to be set on the optical disk 100*a* at the maximum. Then, when the rotatable base 32 rotates clockwise every 90° or 180° and stops, the respective sides, which form the square frame of the cushion sheet 61, are made to correspond to the print operation range (printable area) of the thermal head 58 of the printer mechanism. When the cushion sheet 61 is placed at the position corresponding to the print operation range of the thermal head 58 of the printer mechanism, the convex portion 38 formed on the lower surface of the rotatable base 32 is fit into the concave portion 39 formed on the support tray 35.

An explanation will be next given of the structure of the printer mechanism provided with the printing apparatus.

As shown in FIGS. 2 to 4, a gate-like frame 54 is attached onto the base 3 to be stretched over the support tray 5. A guide shaft 55 is constructed in the inner side of the frame 54, and a carriage 56 is movably attached to the guide shaft 55. At the front surface of the carriage 56, a head cover 57 is formed to be projected. At the lower surface of the head cover 57, a thermal head 58 as a print head is provided. A ribbon cartridge 56, which contains an ink ribbon, is provided to be attachable/detachable to/from the front surface of the carriage 56. In the carriage 56, a running drive mechanism for the carriage 56, a head moving mechanism for the thermal head 58 and an ink ribbon winding mechanism and the like are provided. Moreover, a forward-reverse rotational drive motor for the carriage (stepping motor) 60 as a drive source for each mechanism is attached to the back surface of the carriage 60.

Figure 16A:
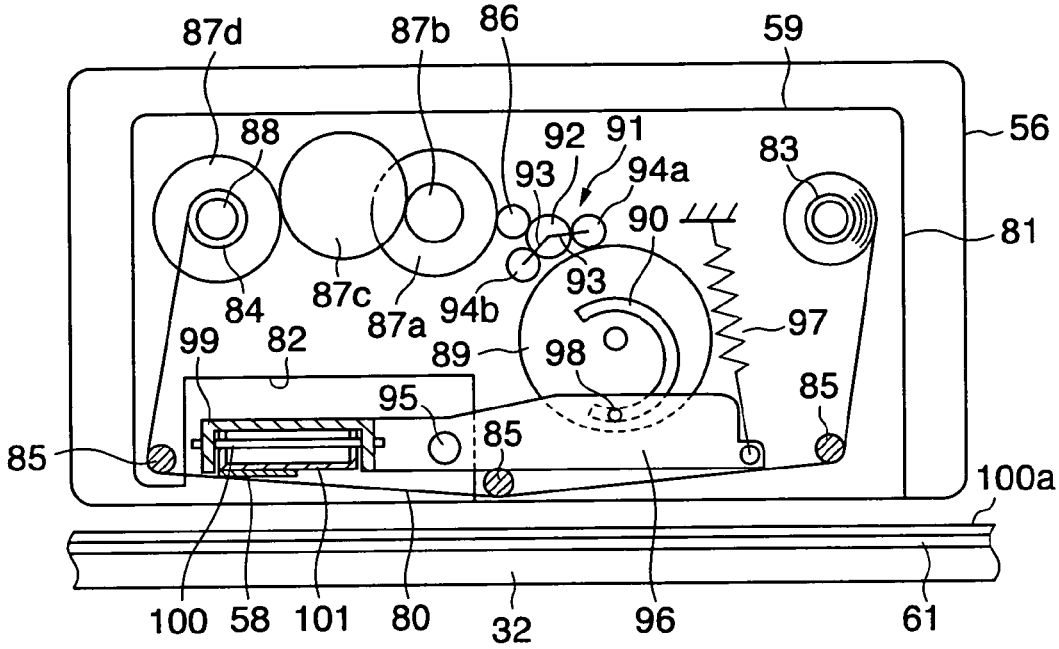
FIGS. 16A and 16B are views each showing the structure of a printer mechanism of the printing apparatus according to the first embodiment of the present invention.

An explanation will be further given of the structure of the printer mechanism based on FIG. 16.

A ribbon cartridge 59, which contains an ink ribbon 80 as a consumable material, is provided to be attachable/detachable to/from the cartridge attaching surface of the front surface of the cartridge 56. The ribbon cartridge 59 includes a case 81. On the case 81, there is formed a concave portion 82 into which the head cover 57 is fit.

In the case 81, a ribbon supply core 83 and a ribbon winding core 84 are provided and the ink ribbon 80 is wound around the ribbon supply core 83 in the form of roll. The ink ribbon 80 paid out from the ribbon supply core 83 is hooked on the winding core 84 through a plurality of guide pins 85. The ink ribbon 80 is sequentially wound around the winding core 84 in accordance with the forward rotation of the winding core 84. The middle of the ink ribbon 80 is exposed to the external section of the case 81 and runs along the lower surface side of the concave portion 82 where the thermal head 58 is positioned.

In the carriage 56, there is provided an output gear 86 attached to an output shaft of the drive motor 60 for a carriage, and a first gear 87*a* meshes with the output gear 86. Moreover, a second gear 87*b* is provided coaxially with the first gear 87*b*. A third gear 87*c* meshes with the second gear 87*b*, and a fourth gear 87*d* meshes with the third gear 87*c*.

Then, a ribbon winding shaft 88 is provided coaxially with a rotating shaft of the fourth gear 87*d* through a one-way clutch (not shown). The ribbon winding shaft 88 projects forward from the cartridge attaching surface of the carriage 56 to engage with the winding core 84 according to the attachment of ribbon cartridge 59 to the cartridge attaching surface.

The third gear 87*c* meshes with the rack (not shown) provided to the frame 54 along a running path of the carriage 56 in parallel with the guide shaft 55. By this mesh, the carriage 56 reciprocates along the guide shaft 55 in accordance with the forward-reversal rotation of the third gear 87*c*.

Moreover, a cam gear 89 is provided in the carriage 56. The cam gear 89 is provided with a gear at its circumference. An arc-shape cam groove 90, which is off-centered against the center of the rotation is formed in the side surface of the cam gear 89. Then, a swing clutch 91 is formed between the cam gear 89 and the output gear 86. The swing clutch 91 is composed of a sun gear 92, which meshes with the output gear 86, and a pair of planet gears 94*a* and 94*b*, which mesh with the sun gear 92 and which are supported to be movable in the circumferential direction of the sun gear 92 through an arm 93. At the forward rotating time of the sun gear 92 (at the rotation time clockwise), one planet gear 94*a* meshes with the cam gear 89 and the other planet gear 94*b* separates from the cam gear 89. Meanwhile, at the reverse rotating time of the sun gear 92 (at the rotation time anticlockwise), one planet gear 94*a* separates from the cam gear 89 and the other planet gear 94*b* meshes with the cam gear 89.

In the carriage 56, there is provided a head arm 96 that rotates up and down around the center of a shaft 95. The head arm 96 is elastically urged counterclockwise in FIG. 16 by a spring 97 provided at the end portion of the one end side in a tensioned state. Further, the head arm 96 is provided with a pin 98 close to the one end portion. The pin 98 is slidably inserted to the cam groove 90 of the cam gear 89. A head holder 99 is attached to the end portion of the other end side of the head arm 96. The head holder 99 is placed in the head cover 57, which projects to the front side of the carriage 56, and extends to the front side of the carriage 56 along the head cover 57. Moreover, a head base 101 is supported at the lower surface of the head holder 99 through a shaft 100. The thermal head 58 as the print head is attached to the lower surface of the head base 101. The thermal head 58 is placed to be opposed to the opening of the lower surface of the head cover 57.

The thermal head 58 is pressed via the ink ribbon paid out from the ribbon cartridge 59, onto the label surface which is opposite to the signal recording surface of the optical disk 100*a* which is held standstill on the stopped rotatable base 32. In this state, the thermal head 58 moves from left to right in FIG. 2 along the guide shaft 56 together with the carriage 59. During this movement, printing is performed by the thermal transfer method in which a predetermined image is thermally transferred to the surface of the optical disk 100*a* as melting ink of the ink ribbon. Accordingly, a rectangular area, which is fixed by the width of the row of heat elements of the thermal head 58 (width in the main scanning direction) and the moving distance of the thermal head 58 (length in the sub-scanning direction) which is perpendicular to the width of the row, becomes a print range obtained by one print operation.

An explanation will be next given of the operation of each component of the printing apparatus.

First, an explanation will be given of an operation in which the support tray 5 moves to the internal and external sections of the case 1. As a preparation before printing, the tray mechanism is ejected to the outside of the apparatus by the ejection operation and the optical disk 100*a* is mounted on the tray and the tray is returned to the printing apparatus, and set to the print position.

At a print starting time, as shown in FIG. 4, the support tray 5 is inserted into the case 1, and the hook receiver 29 is engaged with the hook portion 25 of the hook lever 24. The teeth portion 17*a* of the actuation gear 17 meshes with the small gear of the fourth gear 7*d* of the gear train 7. At this time, the pin 19 of the actuation gear 17 is positioned at the end top portion of the circular path 21 which coincides with the end portion of the guide groove 20 formed in the lower surface of the support tray 5, and the lever 13*a* of the tray position detection switch 13 is placed at the close position C.

From this state, the eject switch 2 at the front of the case 1 is operated. The drive motor 6 for tray starts in accordance with this operation, the rotational power is transmitted to the gear train 7 through the belt 8, and the third gear 7*c* rotates clockwise in FIG. 4. At this time, since the third gear 7*c* and fourth gear 7*d* are coupled to the lug mechanism, only the third gear 7*c* rotates and the fourth gear 7*d* does not rotates, so that the stop state of the support tray 5 is maintained.

When the third gear 7*c* rotates clockwise, the actuation gear 17, which has been meshed with the small gear 9 of the third gear 7*c*, rotates anticlockwise. At this time, the pin 19 of the actuation gear 17 moves to the guide groove 20 through the backward path 21*b* of the circular path 21.

When the actuation gear 17 rotates anticlockwise, the hook lever 24 rotates anticlockwise against the spring 28 through the actuation rod 26 by the actuation gear 17. By this rotation, the hook portion 25 is detached from the hook receiver 29 and the engagement of the support tray 5 is released. When the actuation gear 17 rotates to a fixed angle, the teeth portion 17*a* of the actuation 17 is detached from the small gear 9 and the actuation gear 17 stops at this position.

After that, when the rotational power of the third gear 7*c* is transmitted to the fourth gear 7*d* and the fourth gear 7*d* rotates clockwise together with the third gear 7*c*. By this rotation, the support tray 5 moves toward the front of the case 1. At this time, the pin 19 of the actuation gear 17 relatively moves along the guide groove 20 of the support tray 5. When the support tray 5 starts to move, the front portion side end wall of the concave groove 14 of the support tray 5 separates from the lever 13*a* of the tray position detection switch 13 and the lever 13*a* moves to the neutral position N from the close position C accordingly. Then, when the support tray 5 moves forward and projects to a predetermined length from the case 1, the back side end wall of the concave groove 14 abuts against the lever 13*a* of the tray position detection switch 13 and the lever 13*a* moves to the open position O from the neutral position N accordingly. Based on the switch signal at this time, the drive motor 6 for tray is controlled to be stopped and the support tray 5 thereby stops at a predetermined eject position.

Here, the user mounts the optical disk 100*a* on the rotatable base 32 of the support tray and fits the disk hole at the center of the optical disk 100*a* into the projection piece 41 elastically, so that the optical disk 100*a* is fixed to the rotation base 32.

Next, in the case where the support tray 5 is moved into the apparatus, the user slightly presses the support tray 5 manually. By the pressing operation, the back side end wall of the concave groove 14 separates from the lever 13*a* of the tray position detection switch 13 and the lever 13*a* moves to the neutral position N from the open position O accordingly. Based on the switch signal at this time, the drive motor 6 for tray is driven and reversely rotated. Additionally, even when the operation is performed by the eject switch 2 in place of pressing the support tray 5 manually, the same operation is performed.

The reverse rotational power of the drive motor 6 for tray is transmitted to the gear train 7 through the belt 8, and the third gear 7*c* rotates anticlockwise in FIG. 3. Since the third gear 7*c* is coupled to the fourth gear 7*d* by the lug mechanism, the rotational power of the third gear 7*c* is not initially transmitted to the fourth gear 7*d*. However, after the third gear 7*c* rotates to a fixed angle, the power of the third gear 7*c* is transmitted to the fourth gear 7*d* and the fourth gear 7*d* rotates anticlockwise together with the third gear 7*c*. Moreover, since the teeth portion 17*a* separates from the small gear 9 of the third gear 7*c*, the stop state of the actuation gear 17 is maintained regardless of the rotation of the third gear 7*c*. When it rotates in the anticlockwise direction of the fourth gear 7*d*, the support tray 5 is drawn into the case 1 accordingly. At this time, the pin 19 of the actuation gear 17 relatively moves along the guide groove 20 of the support tray 5.

Figure 5:
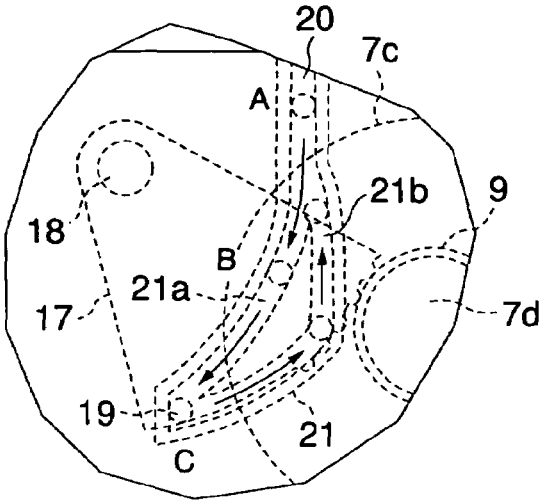
FIG. 5 is a plane structural view showing a principal part of a drive mechanism of a support tray in the printing apparatus of FIG. 1.

When the support tray 5 is drawn into a predetermined position of the case 1, that is, a print position, the front side end wall of the concave groove 14 abuts against the lever 13*a* of the tray position detection switch 13 and the lever 13*a* moves to the close position C from the neutral position N accordingly. Based on the switch signal at this time, the drive motor 6 for tray is controlled to be stopped and the support tray 5 thereby stops at a predetermined print position. Just before the support tray 5 reaches the print position, the pin of the actuation gear 17 reaches a point A of the guide groove 20 in FIG. 5, and further moves to a point B through the outward path 21*a* of the circular path 21 from the point A. Then, in accordance with movement of the pin 19, the actuation gear 17 rotates clockwise and the teeth portion 17*a* meshes with the small gear 9 of the third gear 7*c*. By this mesh, the actuation gear 17 further rotates anticlockwise, and the pin 19 reaches a point C of the end top portion of the circular path 21.

When the actuation gear 17 rotates clockwise, pressure to the actuation rod 26 is released. By this release, the actuation rod 26 is moved to the forward side of the case 1, and the hook lever 24 is rotated clockwise by the urging force of the spring 28. The hook portion 25 is placed at an engage standby position to the hook receiver 29. Thereafter, the support tray 5 moves to the print position and stops. Just before the stop, the hook lever 24 is engaged with the hook portion 25 of the hook lever 24. By this engagement, the support tray 5 is stably positioned at a predetermined print position.

Thus, in the standby state during the start of printing, the support tray 5 is ejected to the outside of the case 1 by the eject operation, and the rotatable base 32 is placed at a predetermined stop position on the support tray 5 at the time of returning to the case 1. Namely, one side of the square of the cushion sheet 61 formed on the upper surface of the rotatable base 32 is positioned to be opposed to the print operation range (printable range) of the thermal head 58. Moreover, the respective convex portions 38 of the lower surface of the rotatable base 32 are fit into the respective concave portions 39 of the upper surface of the support tray 5, so that the lower surface of the rotatable base 32 abuts against the upper surface of the support tray 5.

Moreover, according to this printing apparatus, when printing to one portion on the optical disk 100*a* is ended by one print operation of the printer mechanism, the rotation base 32 is rotated to a next stop position by a predetermined angle in order that printing should be performed to the next print portion on the optical disk 100*a* in the state that the operation of the printer mechanism is stopped. The following will explain the operation of the rotation mechanism.

As explained above, on the upper surface of the support tray 5, the cushion sheet 61 is formed to be square-frame shaped, and the position where each size of the square corresponds to the print operation range of the thermal head 58 becomes a stop possible position, and one to four print areas at the maximum on the optical disk 100*a* can be arbitrarily set.

When the drive motor 45 for a rotatable base is driven, the rotational power due to this drive is transmitted to the rotatable base 32 through the worm gear 46, the large gear 44*a* of the gear 44, the small gear 44*b* of the gear 44, and the gear 35, and the rotatable base 32 rotates clockwise. When the rotatable base 32 rotates, the respective convex portions 38 of the lower surface of the rotatable base 32 slide on the upper surface of the support tray 5, and the friction is thereby reduced and the rotatable base 32 rotates smoothly.

In the case where printing is performed to two portions on the optical disk 100*a*, the rotatable base 32 is rotated 180° after the first printing, so that the second printing is performed. Meanwhile, in the case where printing is performed to four portions on the optical disk 100*a*, the rotatable base 32 is rotated 90° after the first printing, so that the second printing is performed. Then, the rotatable base 32 is rotated every 90° in a like manner, so that the third and fourth printing is performed.

A predetermined rotation angle at which the rotatable base 32 should be rotated is detected by the rotation position detection switch 50 and an output signal from the encoder 48. For example, in the case where a predetermined rotation angle is 90°, this angle is detected with reference to the point that the number of output pulses from the encoder 48 reaches a predetermined number after the rotation position detection switch 50 detects the concave portion 51. In the case where a predetermined rotation angle is 180°, this angle is detected with reference to the point that the number of output pulses from the encoder 48 reaches a predetermined number after the rotation position detection switch 50 detects the second concave portion 51. When the predetermined rotation angle is detected, the drive of the drive motor 45 for a rotatable base is stopped, so that the rotatable base 32 stops. When rotation of the rotatable base 32 stops, the cushion sheet 61 is always provided at the position corresponding to the print operation area of the thermal head 58.

Figure 6B:
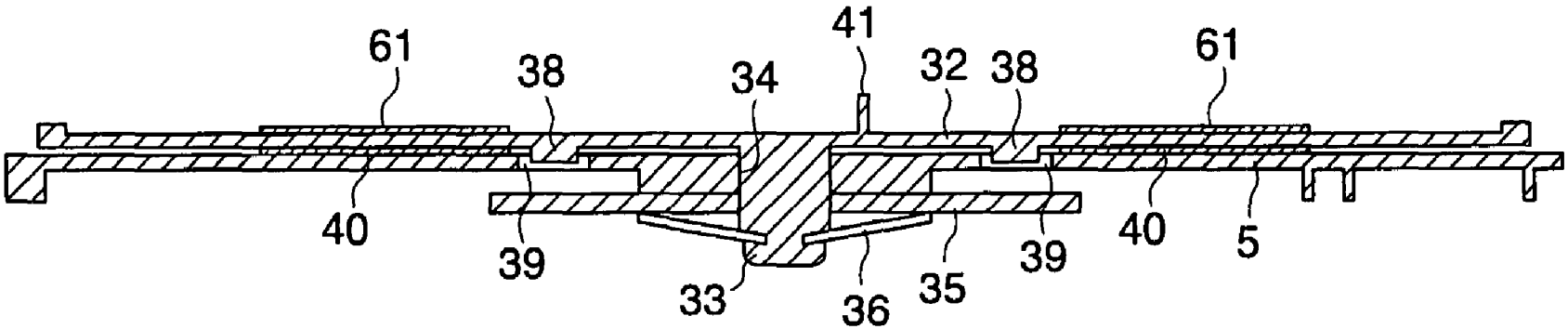

When the rotatable base 32 rotates to the predetermined angle and the cushion sheet 61 is provided at the position corresponding to the print operation area of the thermal head 58, the respective convex portions 38 fall in the respective concave portions 39 of the support tray 5 and fit thereto by the urging force of belleville-spring 36 as shown in FIG. 6B. In other words, the rotatable base 32 is moved downward. By this movement, the rotatable base 32 is adhered to the support tray 5 through the friction sheet 40, so that the rotatable base 32 is stably supported at the position with a predetermined rotation angle.

Figure 11A:
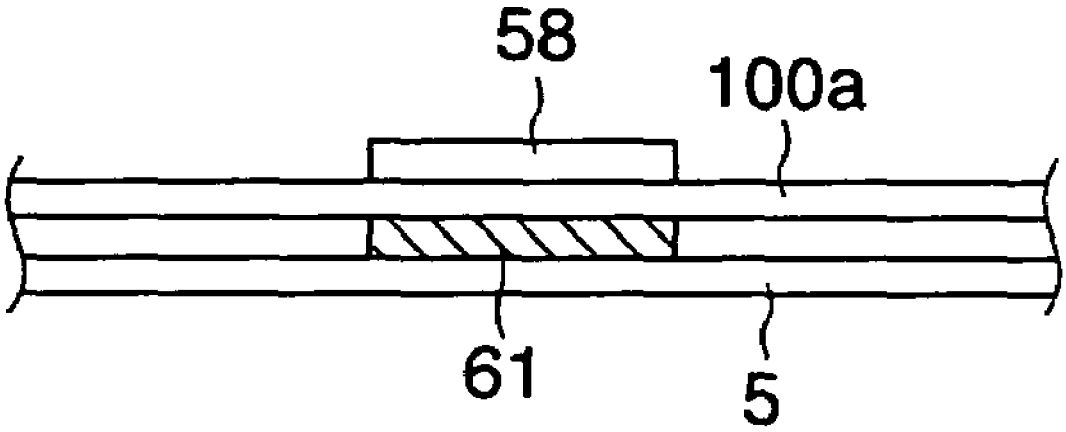
FIGS. 11A and 11B are explanatory views each showing a relationship in the position between a thermal head for printing and a cushion sheet on the rotational sheet in the printing apparatus of FIG. 1.

According to the above-structured printing apparatus, on the upper surface of the rotatable base 32 that supports the optical disk 100*a*, the cushion sheet 61 is adhered to the area corresponding to the moving area of the thermal head 38 at the print operation time. The cushion sheet 61 has the size corresponding to the width of the row of heat elements of the thermal head 58 and the length of the movement thereof. For this reason, when the thermal head 58 presses against the surface of the optical disk 100*a*, the cushion sheet 61 is equally elastically deformed in the direction of the heat element row of the thermal head 58, so that the heat element row of the thermal head 58 comes in contact with the surface of the optical disk 100*a* uniformly as shown in FIG. 11A. As a result, satisfactory printing can be performed.

Figure 11B:
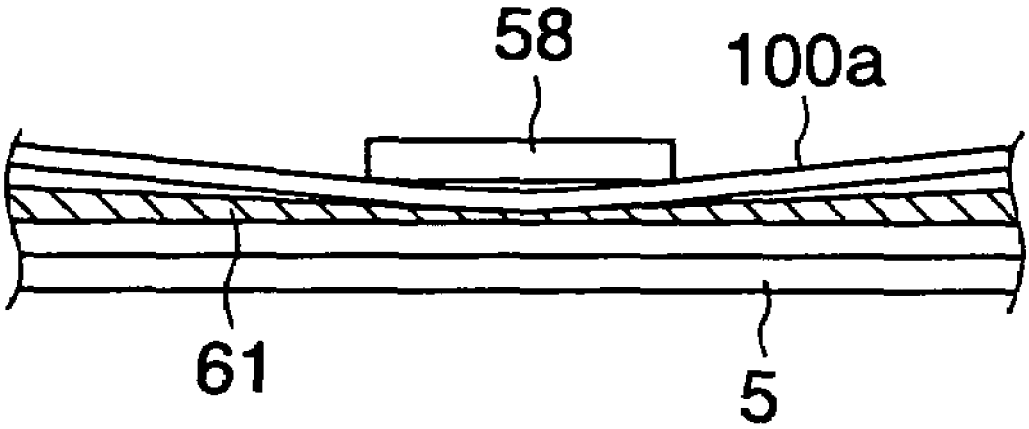

In the case where the cushion sheet 61 is adhered to the entire area of the upper surface of the support tray 5 as shown in FIG. 11B, the cushion sheet 61 is not equally elastically deformed because the optical disk 100*a* made of plastic plate material is bent as shown in FIG. 11B by the pressure of the thermal head 58. For this reason, there occurs imbalance that pressing force at the central portion of the heat element row of the thermal head 58 is insufficient as compared with pressing force at both end portions thereof, exerting an unfavorable influence upon printing.

However, according to this embodiment, since the cushion sheet 61 has the size corresponding to the moving range of the thermal head 58, pressing force becomes equal as each portion, so that satisfactory printing can be performed.

Moreover, as shown in FIG. 6B, the respective convex portions 38 of the rotatable base 32 are fit into the respective concave portions of the support tray 5, and the lower surface of the rotatable base 32 is adhered to the upper surface of the support tray 5 through the friction sheet 40. The rotatable base 32 is structured such that the convex portions 38 formed on the lower surface to reduce a resistance load at the time of rotating operation slide on the upper surface of the support tray 5. However, at the predetermined rotation stop position of the rotatable base 32, a space formed between the upper surface of the support tray 5 and the lower surface of the rotatable base 32 is eliminated, so that the optical disk 100*a* is stably supported against the pressing from the thermal head 58. Moreover, this prevents accidental rotation of the rotatable base 32 when the thermal head 58 moves.

Furthermore, when the rotatable base 32 is driven to be rotated by the drive motor 45 for a rotatable base, the power is transmitted to the rotatable base 32 through the gear train including the worm gear 46, that is, the worm gear 46, the large gear 44*a* of the gear 44, the small gear 44*b* of the gear 44, and the gear 35, so that the rotatable base 32 rotates clockwise as shown by an arrow in FIG. 3. Though this will be described later, the rotational operation of the rotatable base 32 and the moving operation of the thermal head 58 are performed not simultaneously but alternatively. The thermal head 58 performs printing as moving from the home position, which is the left end side of the frame 54 shown in FIGS. 2 to 4, to the right direction at the time of the print operation. In this way, at the printing portion on the rotatable base 32, which is positioned at the front side of the support tray 5, where the thermal head 58 moves to perform printing, such a relationship is established that the rotational directional of the rotatable base 32 and the moving direction of the thermal head 58 at the print operation time are opposite to each other.

When the thermal head 58 and the rotatable base 32 are alternatively driven, at the printing portion of the rotatable base 3, for example, the thermal head 58 moves from the left to the right at the print operation time 2. On the contrary to this, when the rotational direction of the rotatable base 32 and the moving direction of the thermal head 58 at the print operation time are the same as in the case that the rotation of the rotatable base 32 is anticlockwise, there is a fear that the rotatable base 32 will rotate slightly at the time when the thermal head 58 is started to move by backlash caused by play of mesh of the teeth in the gear train. However, according to this embodiment, since the rotational directional of the rotatable base 32 and the moving direction of the thermal head 58 at the print operation time are opposite to each other, no backlash occurs and slight rotation of the rotatable base 32 can be prevented, so that satisfactory printing can be performed.

As further explanation is given, friction between the thermal head 58 and the back surface of the ink ribbon is extremely small. While, large friction is generated between a surface, which is opposite to the back surface of the ink ribbon, where ink is coated and the surface of the optical disk 100*a* where the ink-coated surface abuts. Since the friction between the thermal head 58 and the back surface of the ink ribbon is extremely small and sliding occurs therebetween, no force is applied onto the optical disk 100*a* in accordance with the movement of the thermal head 58 even if the thermal head 58 moves on the optical disk 100*a*. However, when slight friction is generated between the thermal head 58 and the back surface of the ink ribbon for some reason, this becomes power that allows the optical disk 100*a* to be moved in the direction corresponding to the moving direction of the thermal head 58 and acts on the support tray 5 through the optical disk 100*a*, so that rotation is performed by the amount corresponding to the backlash of the gears which form the rotation drive mechanism of the support tray 5. For this reason, according to this embodiment, the support tray 5 is stopped during the print operation and printing is performed in a state that the optical disk 100*a* as the printing object to be mounted standstill, and this prevents the printing object from moving during the print operation and an unfavorable influence from being exerted upon the printing result.

Moreover, the gear train includes the worm gear 46 having a merit that it has efficient control over a force applied from the side of the load opposite to the side of the drive source. This eliminates the accidental rotation of the rotatable base 32 and the rotatable base 32 is maintained in a fixed state without fail, so that satisfactory printing can be performed.

An explanation will be next given of the operation of the printer mechanism.

In the printer mechanism at a print standby time, the head arm 96 on the carriage 56 is held substantially horizontally and the thermal head 58 is placed at a print standby position spaced from the surface of the optical disk 100*a* by a fixed distance. Moreover, the carriage 56 stops at the home position set in the vicinity of the left end proton of the moving range.

Next, when printing is started, the drive motor 60 for a carriage is driven forward and the output gear 86 rotates anticlockwise. The rotational power of the output gear 86 is transmitted to the first, second, third and fourth gears 87*a*, 87*b*, 87*c*, and 87*d*. Then, the third gear 87*c*, which meshes with the rack, rotates anticlockwise and thereby the carriage 56 is moved along the guide shaft 55 in the right direction. Moreover, the fourth gear 87*d* rotates and thereby the ribbon winding shaft 88 rotates in the ribbon winding direction together with the fourth gear 87*d*. Accordingly, the winding core 84 in the ribbon cartridge 59, which engages with the ribbon winding shaft 88, rotates and thereby the ink ribbon 80 is sequentially wound and runs.

In parallel with this operation, the sun gear 92 of the swing clutch 91 is driven to be rotated by the rotation of the output gear 86. In accordance with the rotation of the sun gear 92, one planet gear 94*a* comes close to the cam gear 89 to mesh with the cam gear 89. By this mesh, the rotational power of the sun gear 92 is transmitted to the cam gear 89, so that the cam gear 89 rotates clockwise.

Figure 16B:
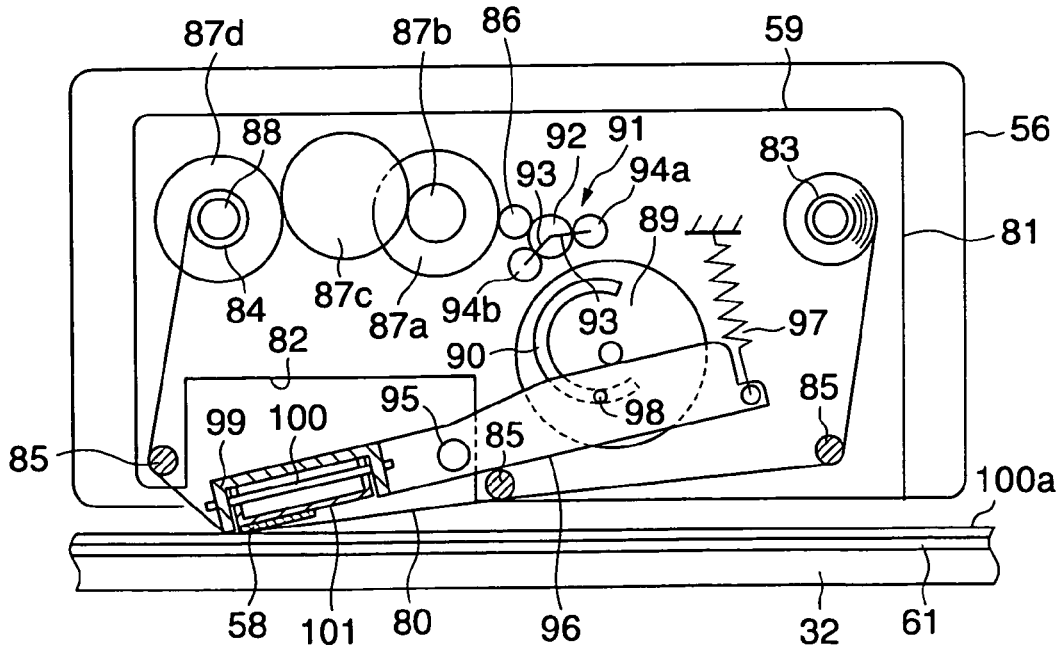

The cam gear 89 rotates clockwise in the forward direction and thereby the pin 98 in the cam groove 90 moves upward together with the head arm 96. The head arm 96, which moves with the pin 96, rotates anticlockwise around the shaft 95. By this rotation, the thermal head 58 moves downward and inclines with respect to the horizontal direction as shown in FIG. 16B.

The tooth omitting portion (not shown) is formed on a part of the periphery of the cam gear 89. When the cam gear 89 rotates by a fixed angle, the planet gear 94*a* falls in the omitting portion and runs idle. As a result, the thermal head 58 is held at the print position, which maintains a predetermined inclination angle and which contacts the surface of the optical disk 100*a* to sandwich the ink ribbon 80 therebetween. In this case, the thermal head 58 comes in contact with the surface of the optical disk 100*a* at a predetermined pressure by elastic force due to the spring 97. When the motor is further driven forward, since the planet gear 94*a* is positioned in the tooth omitting portion, the ink ribbon 80 is driven to be wound while the carriage 56 is moved in the right direction in a state that the thermal head 58 is maintained at the print position.

Then, at the same time with the movement of carriage 56 and the winding of ink ribbon 80, the heating material of thermal head 58 is driven to be heated based on print data and ink of the rink ribbon 80 is sequentially melted, thermally transferred on the surface of the optical disk 100*a*, so that a character such as predetermined letter, mark, and the like is printed on a predetermined print area corresponding to the moving range of the carriage 56 (thermal head 58).

When the thermal head 59 ends the printing, the motor 60 is driven reservedly and the output gear 86 rotates in a reverse direction (clockwise). By the reverse rotation of the output gear 86, the third gear 87*c* also rotates reversely clockwise. In accordance with the reverse rotation of the third gear 87*c*, the carriage 56 moves in the reverse direction (left direction) along the guide shaft 55, and returns to the home position.

At this point, since the fourth gear 87*d* is coupled to the ribbon winding shaft 88 through the one-way clutch, the reverse rotating operation of the fourth gear 87*d* is not transmitted to the ribbon winding shaft 88 and the ribbon 80 is not wound.

At the same time, by the reverse rotation of the output gear 86, the sun gear 92 of the swing clutch 91 rotates reversely. By the reverse rotation of the sun gear 92, one planet gear 94 separates from the cam gear 89 and other planet gear 94*b* comes close to the cam gear 89, and meshes therewith. By this mesh, the rotational power of the sun gear 92 is transmitted to the cam gear 89, and the cam gear 89 rotates reversely anticlockwise.

Then, by the reverse rotation of the cam gear 89, the pin 98 in the cam groove 90 moves downward together with the head arm 96. Then, the head arm 96 rotates around the shaft 95 clockwise. By this rotation, the thermal head 58 moves upward and separates from the surface of the optical disk 100*a*, and the head arm 96 returns to the initial horizontal state. In addition, the tooth omitting portion (not shown) is formed on a part of the periphery of the cam gear 89. When the cam gear 89 rotates by a fixed angle and the thermal head 58 returns to the print standby position, the planet gear 94*b* falls in the omitting portion and runs idle. After the planet gear 94*b* falls in the omitting portion, only the carriage 56 moves in the reverse direction (left direction) by the rotation of the motor 60 in a state that the thermal head 58 is maintained at the print standby position.

Figure 10:
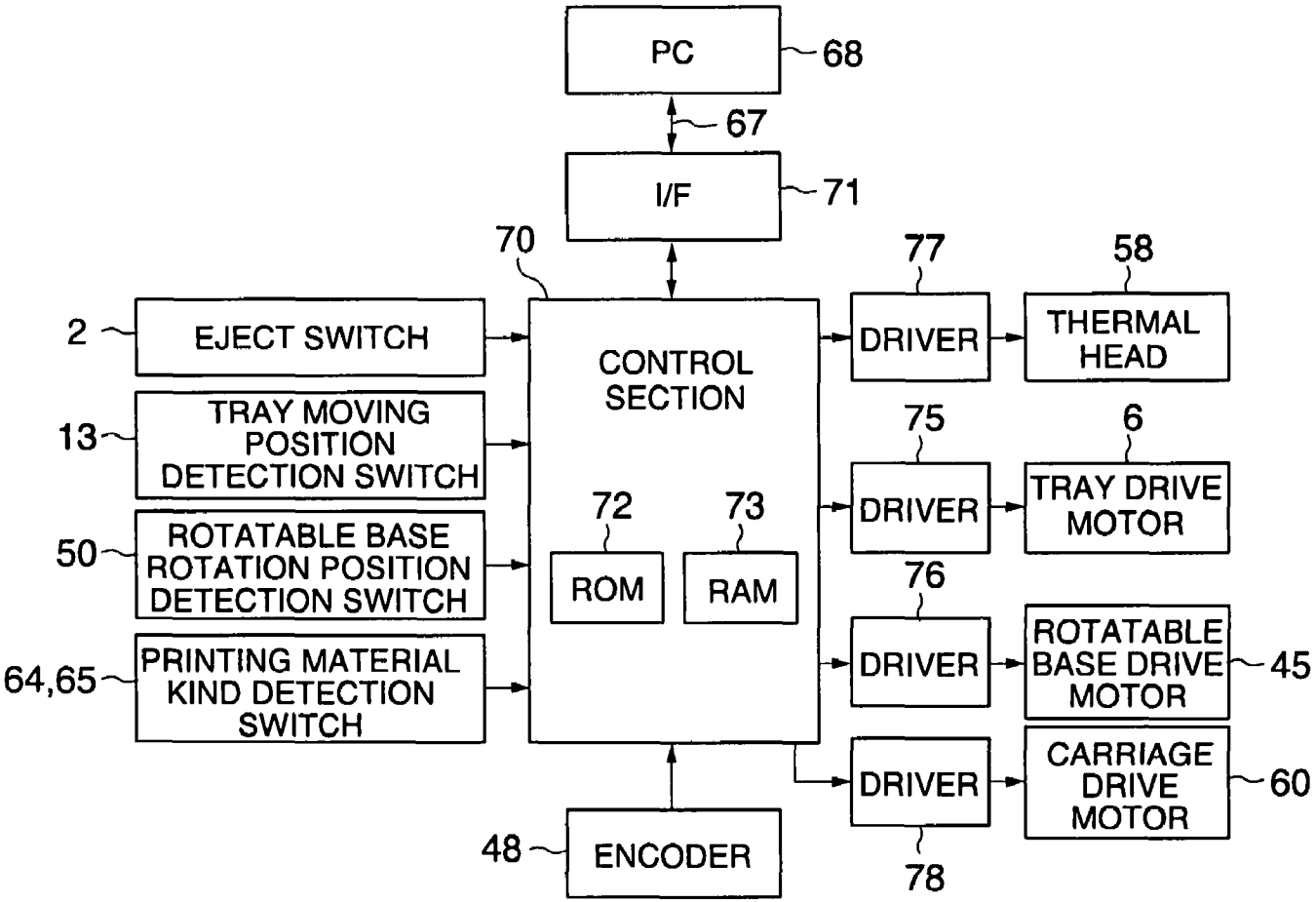
FIG. 10 is a block diagram showing the structure of an electronic circuit of the printing apparatus of FIG. 1.

FIG. 10 shows the structure of an electrical circuit of the printing apparatus according to this embodiment. The printing apparatus includes a control section 80. A personal computer 68 is connected to the control section 70 by an USB cable 67 via an interface (I/F) 71.

The control section 70 includes a ROM 72 and a RAM 73. In the ROM 72, program data such as a system program that controls the operation of each component of the printing apparatus in accordance with a print control signal from the personal computer 68 is stored. Moreover, in the RAM 73, a memory that sores print data transmitted from the personal computer is included.

Further, the ink jet switch 2, tray position detection switch 13 that detects the moving position of the support tray 5, rotatable base's rotation position detection switch 50 that detects the rotation position of the rotatable base 32 on the support tray 5, printing material kind detection switches 64 and 65 that detect the kind of printing object (to be explained in a second embodiment), and encoder 48 are connected to the control section 70, respectively. Output signals of these components are supplied to the control section 70.

Then, the motor 6 for a tray, drive motor 45 for a rotatable base, thermal head 58, and drive motor 60 for a carriage are connected to the control section 70 via a drive circuit 70, a drive circuit 76, a drive circuit 77, and a drive circuit 78, respectively.

Figure 14:
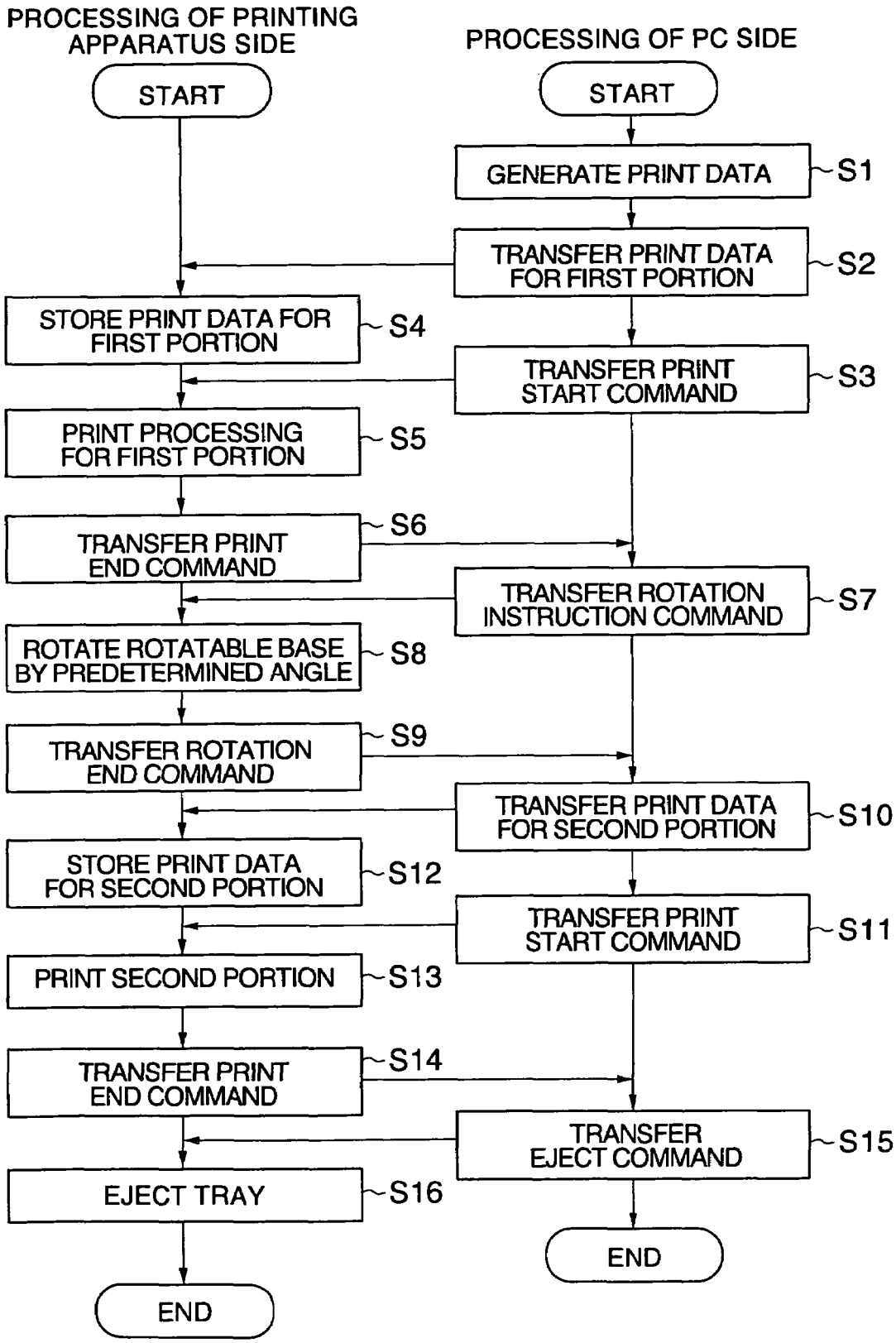
FIG. 14 is a flowchart showing print processing of the printing apparatus according to the first embodiment of the present invention.

An explanation will be next given of print processing of the printing apparatus with reference to the flowchart of FIG. 14. This print processing shows a case in which printing is performed to two areas P1 and P2 on the optical disk 100*a* as shown in FIG. 2.

The support tray 5 is drawn to the outside of the printing apparatus by the eject operation, and the optical disk 100*a* is set and moved into the apparatus. Also, a character string to be printed to two positions on the optical disk 100*a* is input from the keyboard of the personal computer 68. Then, when printing is instructed from the personal computer 68, print data corresponding to the input character string is generated by the personal computer 68 (step S1), and print data for performing printing onto the area P1, i.e., the first portion on the optical disk 100*a* is transferred to the printing apparatus (step S2). Moreover, a print start command is transferred to the printing apparatus from the personal computer 68 (step S3).

The printing apparatus stores the print data for the area P1, i.e., the first portion received from the personal computer 68 to the RAM 73 (step S4), and performs print processing to the area P1, the first portion on the optical disk 100*a* upon reception of the print start command (step 5).

More specifically, the control section 70 of the printing apparatus drives the motor 60 for a carriage forward, so that the thermal head 58 is moved to the print position that abuts against the label surface of the optical disk 100*a*. The control section 70 transfers print data stored in the RAM 73 to the thermal head 58 one line by one as moving the carriage 56 from the home position along the moving path. The control section 70 performs thermal printing for a first portion to the label surface of the optical disk through the ink ribbon by driving the thermal head 58. At the print time, on the upper surface of the support tray 5, the cushion sheet 61 having the size corresponding to the moving range is provided on the area corresponding to the moving range of the thermal head 58. For this reason, when the heat element row of the thermal head 58 presses against the label surface of the optical disk 100*a*, the thermal head 58 comes in contact with the surface of the optical disk 100*a* uniformly because the cushion sheet 61 is equally elastically deformed in the aligning direction of the heat element row. Thereby, satisfactory printing is performed. When the thermal head 58 ends printing of all print data onto the first portion, the control section 70 stops the drive of the thermal head 58 and drives the drive motor 60 for a carriage reversely, so that the thermal head 58 is moved from the label surface of the optical disk 100*a* to a non-print position and the carriage 56 is moved to the home position.

Then, when the carriage returns to the home position, the drive motor 60 for a carriage is stopped, so that the first print operation is ended. When the printing ends, the printing apparatus sends a print end command to the personal computer 68 (step S6).

The personal computer 68 that has received the print end command sends a rotation instruction command of support tray 5 to the printing apparatus (step S7). Next, the printing apparatus drives the drive motor 45 for a rotatable base to rotate the rotatable base 32 clockwise. Then, when the rotatable base 32 rotates by a predetermined angle, the drive of the drive motor 45 for a rotatable base is stopped (step S8). Here, the predetermined angle is 180°. Namely, as mentioned above, on the outer peripheral surface of the rotatable base 32, the concave portions 51 are formed at 90 degrees intervals, and after the rotatable base's rotation position detection switch 50 detects the second concave portion 51, the rotation angle at which the number of output pulses from the encoder 48 reaches a predetermined number is set to 180°. The drive of the drive motor 45 for a rotatable base is stopped when the rotation angle of 180° is detected based on the signals of the rotatable base's rotation position detection switch 50 and encoder 48.

The rotatable base 32 rotates 180° and thereby the cushion sheet 61, which is positioned at the opposite side of the cushion sheet 61, is placed at the position corresponding to the print operation area of the thermal head 58. This state becomes a predetermined stop position for the rotatable base 32 where the cushion sheet 61 is positioned to be opposite to the print operation area of the thermal head 58. As mentioned above, at this position, the lower surface of the rotatable base 32, which floats from the support tray 5 by contacting only the convex portion 38 during rotation, abuts against the upper surface of the support frame 5.

When the rotation operation of the rotatable base 32 is ended, the printing apparatus sends a rotation end command to the personal computer 68 (step S9).

Upon reception of the rotation end command from the printing apparatus, the personal computer 68 sends print data for the second area P2, i.e., a second portion on the optical disk 100*a* to the printing apparatus (step S10), and sends a print start command (step S11).

The printing apparatus stores print data for a second portion that has received from the personal computer 68 to the RAM 73 (step S12), and performs print processing of print data for a second portion upon reception of the print start command (step S13). In connection with this print processing, similar to step S6, the print operation of the printer mechanism is performed to the optical disk 100*a* that is held on the rotatable base 32 in a stationary manner. At this time, regarding the optical disk 100*a*, the print area for a second portion on the optical disk 100*a* is positioned with respect to the printer mechanism by the rotation processing of step S8. When printing for a second portion on the optical disk 100*a* ends, the printing apparatus sends a print end command to the personal computer 68 (step S14).

After that, the personal computer 68 sends an eject command for ejecting the support tray 5 (step S15). Then, the printing apparatus that has received the command drives the drive motor 6 for a tray to eject the support tray 5 to the outside of the case 1 (step S16). This makes it possible to take up the optical disk 100*a* having a desired character string on upper and lower areas P1 and P2 that sandwich a circular hole as a center.

Here, the direction in which the character strings to be printed on the areas P1 and P2 face may be arbitrarily controlled by a setting operation. For example, let a case be considered where the first print operation is performed to the first print area P1 of the optical disk 100*a* shown in FIG. 2 in a manner that the upper side of a character string "ABC" comes to the side of the circular hole of the optical disk 100*a*, and a character string "EFG" is printed on the second print area P2 of the optical disk 100*a* with the character string's lower side coming to the side of the circular hole of the optical disk 100*a*. In the printing operation to be performed to the first area P1, print pattern data in which the characters in the character string "ABC" are expanded normally in the order of the characters is transferred to the thermal head 58 line by line in that order of the characters when the carriage 56 moves from left to right of FIG. 2 (from upper side to lower side of FIG. 1), thereby printing is performed. In the printing operation to be performed to the second area P2, printing is performed by transferring a print pattern in which the character string "EFG" is expanded in a manner that it is turned upside down and left-side right, to the thermal head 58 line by line. Or, print pattern data in which the characters are laid in the normal order may be expanded, and may be read out reversely and turned upside down when it is transferred to the thermal head 58. Additionally, in the case where the character strings to be printed to the areas P1 and P2 should be both laid out with their upper sides coming to the side of the circular hole, print pattern data in which the characters are laid in the normal order may be generated and transferred to the thermal head 58 in the order of the characters in each printing operation.

In addition, the printing apparatus sent the end command to the personal computer 68 every time when print processing and rotation processing ended, and received the start command for next processing from the personal computer 68. However, the printing apparatus may, at first, receive print data for two portions and the print start command from the personal computer 68, and all of a series of processing thereafter may be controlled to be performed by only the printing apparatus. Moreover, a keyboard, a display section, memory of character fonts may be provided to the printing apparatus to have the function of accepting data input, the function of editing input data, and the function of generating printed data, and thereby all processing and control may be singly performed by the printing apparatus without the need of connecting to the personal computer 68.

As explained above, according to the first embodiment, after printing for a first portion is performed to the label surface of the optical disk 100*a*, the rotatable base 32 on which the optical disk 100*a* is mounted is automatically rotated by a predetermined angle to perform printing for a second portion. Accordingly, such a complicated task is not needed that the support tray 5 is ejected to change the direction of the optical disk 100*a* every time when printing is performed to the other portion subsequent to performing printing to one portion of the label surface of the optical disk 100*a*. This makes it possible to provide printing to a plurality of portions of the surface of the optical disk 100*a* easily and efficiently.

Moreover, in this printing apparatus, at the time of performing print processing to the first and second portions in steps S5 and S13, the thermal head 58 and the drive motor 60 for a carriage are driven to perform a print operation. During the print operation, the drive motor 45 for a rotatable base that drives the support tray 5 stops driving, and the support tray 5 is in a stationary state. Further, in step S8, when the support tray 5 is driven to be rotated, the print operation is in a stop state. In this way, printing means and rotation driving means are selectively driven and both are not simultaneously driven and this provides advantages in which peak consumption power of the driving apparatus can be reduced, the scale of the driving power supply to be mounted on the printing apparatus can be decreased, and the driving power circuit can be made compact at low cost.

(Second Embodiment)

An explanation will be next given of the printing apparatus of the second embodiment.

The printing apparatus of the first embodiment was used to perform printing to the label of the optical disk 100*a*. The printing apparatus of the second embodiment has the function capable of performing printing to both the label of the optical disk 100*a* and paper material.

Figure 9:
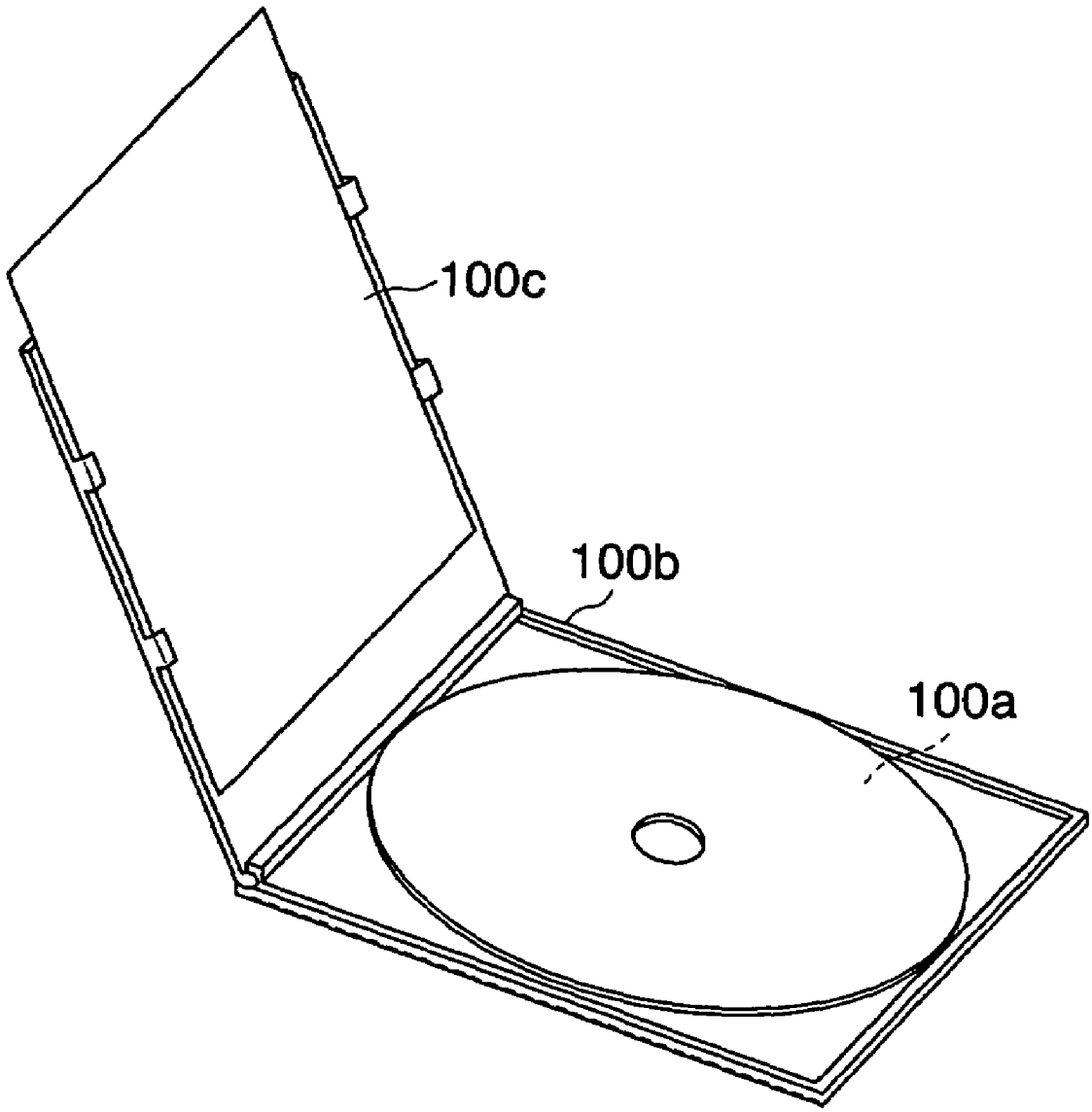
FIG. 9 is a perspective view showing an optical disk as a printing object and a paper material.

Generally, as shown in FIG. 9, the optical disk 100*a* such as CD-R and the like is contained in a transparent case 100*b*, and paper material 100*c* such as a cover, jacket, and the like is further contained in the case 100*b*. The paper material 100*c* has a rectangular shape whose one side, which is substantially the same length as the diameter of the disk-like optical disk 100*c*.

In the printing apparatus of this embodiment, such the optical disk 100*a* and paper material 100*c* are used as printing objects. The rotatable base 32 has a circular shape corresponding to the disk-like optical disk 100*a*, and the support tray 5 has a rectangular shape corresponding to the paper material 100*c*.

Figure 12:
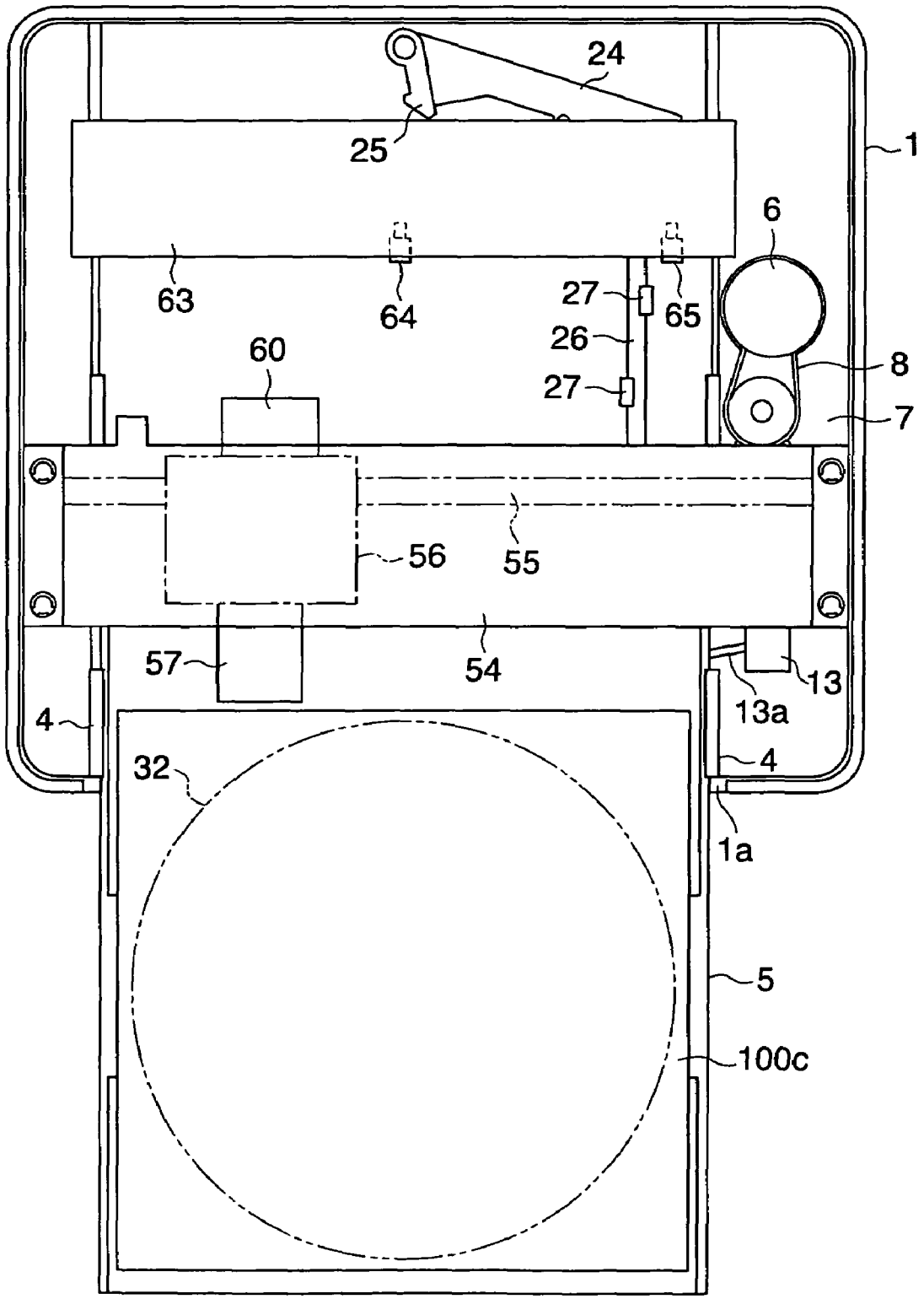
FIG. 12 is a plane structural view at the time of ejecting the support tray when printing is performed to the paper material.
Figure 13:
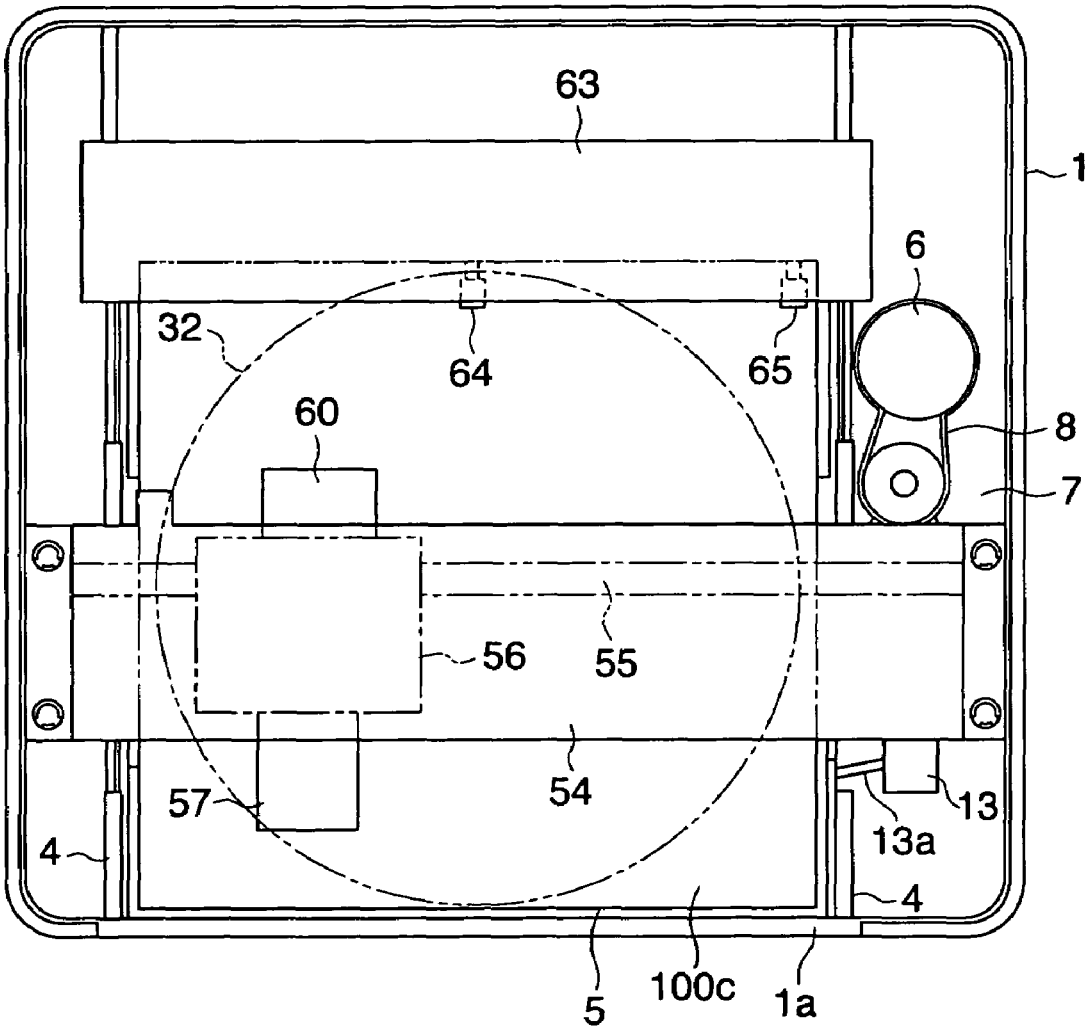
FIG. 13 is a plane structural view at the time of inserting the support tray when printing is performed to the paper material.

Then, at the time of printing the title and the like to the optical disk 100*a*, the optical disk 100*a* is mounted on the rotatable base 32, and at the time of printing the title and the like to the paper material 100*c*, the paper material 100*c* is mounted on the support tray 5 including the rotatable base 32. FIG. 12 shows a state where the paper material 100*c* is mounted on the support tray 5 which is drawn out of the apparatus, and FIG. 13 shows a state where the support tray on which the paper material 100*c* is mounted is moved to a predetermined print position in the apparatus.

Then, since the printing apparatus of the embodiment makes it possible to perform printing to a different printing object, the kinds of printing objects are detected to allow print processing to be executed accordingly.

Namely, a gate-like frame 63, which is positioned at the back side of the frame 54, is attached onto the base 3 of the case 1. A pair of first and second detection switches 64 and 65 as kind detection means for detecting the kind of printing object is attached to the lower surface of the frame 63. The first and second detection switches 64 and 65 are spaced from each other to have a predetermined distance in a width direction of the case 1. The first detection switch 64 is attached to substantially the intermediate portion of the frame 63, and the second detection switch 65 is attached to the position biased to one end of the frame 63.

Figure 8A:
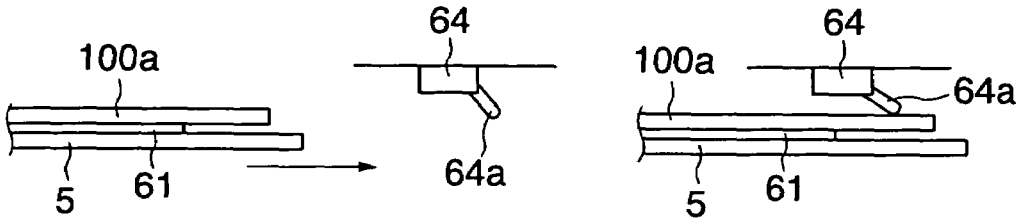
FIGS. 8A and 8B are structural views each showing a kind detection switch that detect a kind of a printing object in the printing apparatus of FIG. 1.
Figure 8B:
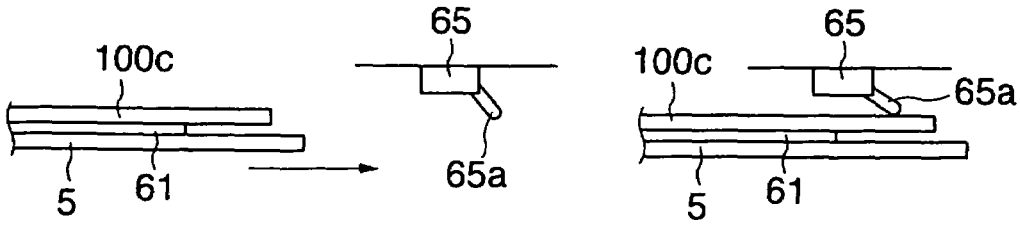

Then, the optical disk 100*a* is mounted on the rotatable base 32, and when the support tray 5 is drawn into the case 1 and inserted thereto in this state, the peripheral portion of the optical disk 100*a* comes in contact with an actuator 64*a* of the first detection switch 64 as shown in FIG. 8A, so that the first detection switch 64 is turned on. At this time, the optical disk 100*a* does not come in contact with the second detection switch 65, and the second detection switch 65 therefore remains being turned off. Also, the paper material 100*c* is mounted on the support tray 5 as shown in FIG. 12, and when the support tray 5 is drawn into the case 1 and inserted thereto as shown in FIG. 13 in this state, the peripheral portion of the paper material 100*c* comes in contact with an actuator 64*a* of the first detection switch 64, so that the first detection switch 64 is turned on. At the same time, as shown in FIG. 8B, the peripheral portion of the paper material 100*c* comes in contact with an actuator 65*a* of the second detection switch 65, so that the second detection switch 65 is turned on. The kind of printing object can be judged by the operational combination of such two detection switches.

Figure 17:
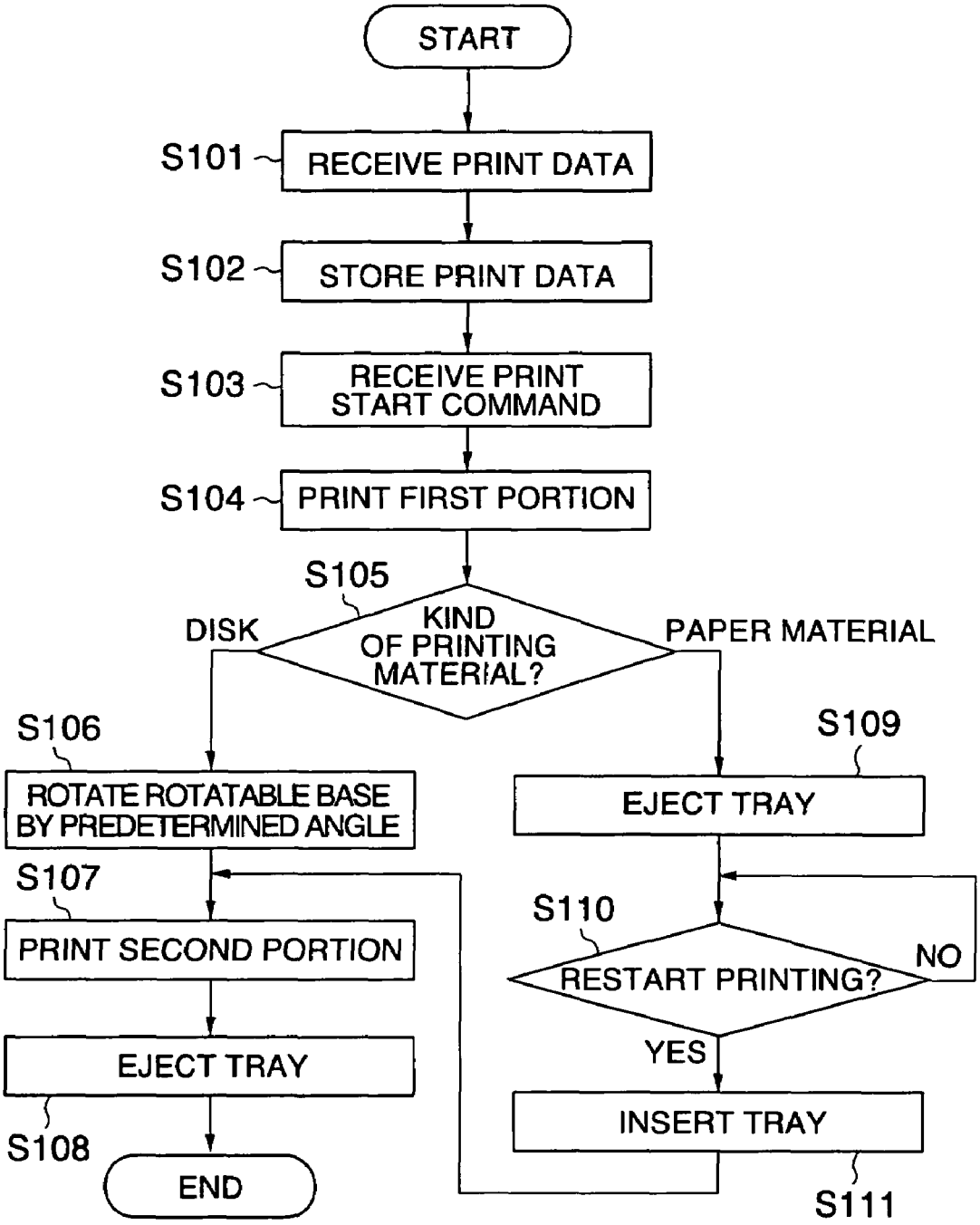
FIG. 17 is a flowchart showing print processing of a printing apparatus according to a second embodiment of the present invention.

FIG. 17 is a flowchart showing print processing of the printing apparatus according to the second embodiment.

In this print processing, either the optical disk 100*a* or paper material 100*c* as a printing object is set on the support tray 5. Two portions are preset as printing portions.

First, the printing apparatus receives print data for two portions transferred from the personal computer 68 (step S101), and stores the print data to the RAM 73 (step S102). Sequentially, the printing apparatus receives a print start command from the personal computer 68 (step S103).

The control section 70 of the printing apparatus drives the drive motor 60 for a carriage forward to move the thermal head 58 to the print position abutting against the label surface of the optical disk 100*a*. The control section 70 transfers print data for the first portion stored in the RAM 73 to the thermal head 58 one line by one as moving the carriage 56 from the home position along the moving path. The control section 70 performs thermal printing to the printing object through the ink ribbon by driving the thermal head 58. After printing, the control section 70 drives the drive motor 60 for a carriage reversely to return the thermal head 58 to the home position (step S104).

At the print time, on the upper surface of the support tray 5, the cushion sheet 61 having the size corresponding to the moving range is provided on the area corresponding to the moving range of the thermal head 58. For this reason, when the thermal head 58 presses against the label surface of the paper material 100*c* equally, so that satisfactory printing can be performed.

Next, the control section 70 determines the kind of printing object based on the operation states of the first and second detection switches 64 and 65 (step S105). The control section 70 determines that the printing object is the optical disk 100*a* when the first detection switch 64 is ON and the second detection switch 65 is OFF. While, the control section 70 determines that the printing object is the paper material 100*c* when both the first detection switch 64 and the second detection switch 65 are ON.

When the printing object is determined as the optical disk 100*a* in step S105, the control section 70 drives the drive motor 45 for a rotatable base to rotate the rotatable base 32 clockwise in order to perform printing for a second portion to the label surface of the optical disk 100*a*. After that, when rotating the rotatable base 32 180°, the control section 70 stops the drive of the motor 45 based on signals from the rotation position detection switch 50 and the encoder 48 (step S106).

Then, the control section 70 performs printing for a second portion to the label surface of the optical disk 100*a* (step S107). When the print processing for a second portion is ended, the control section 70 drives the drive motor 6 for a tray to eject the support 5 to the outside of the case 1, and ends the processing (step S108, END).

When determining that the printing object is the paper material 100*c* after the end of the printing for a first portion, the control section 70 drives the drive motor 45 for a rotatable base to drive the drive motor 6 for a tray without rotating the support tray 5 180°, and ejects the support tray 5 to the outside of the apparatus (step S109).

The user extracts the paper material 100*c* from the ejected support tray 5, and rotates the paper material 100*c* 180° manually in the horizontal plane to change the direction. In this state, the user mounts the paper material 100*c* on the support tray 5 again to make preparations for printing for a second portion.

After that, a standby state for print restart instruction is set. For example, when judging that that the print restart is instructed by the eject switch operation done by the user (step S110), the control section 70 drives the drive motor 6 for a tray to pull the support tray 5 to the print position of the apparatus (step S111). After the support tray 5 moves to a predetermined position of the apparatus, the control section 70 performs print processing for a second portion in the same way as the print processing for a first portion (step S112). When the print processing for a second portion is ended, the control section 70 ejects the support tray 5 to the outside of the apparatus and ends the processing (step S113, END).

In the printing apparatus of the second embodiment, since the printing area is set to a plurality of portions of the label surface of the optical disk 100*a*, the optical disk 100*a* is driven to be rotated in the apparatus. Moreover, in terms of the structure in which printing means and rotation driving means are selectively driven, the same effect as the printing apparatus according to the first embodiment can be obtained.

It is assumed that when the size of one size of the paper material 100*c* is substantially the same as the diameter of the optical disk a, the rotatable base 32 is rotated in the case 1 to change the direction of the paper material 100*c* automatically to deal with the printing to a plurality of portions after the printing to one portion is ended. In this case, a rotation diameter of the rectangular paper material 100*c* is equal to the length of a diagonal line, and the length becomes larger than the diameter of the disk-like optical disk 100*a*. For this reason, there is a need to increase the size of the support tray 5 that supports these two printing objects and the size of the case 1 that contains in consideration of the rotation of the square paper material 100*c*, with the result that the entirety of the printing apparatus will be enlarged.

However, in the printing apparatus according to the second embodiment, the rotatable base 32 is rotated in the case 1 to change the direction automatically on only the case of the disk-like optical disk 100*a*. In the case of the rectangular paper material 100*c*, the support tray 5 is ejected to change the direction manually every time when one printing ends. For this reason, the width of the support tray 5 is made a little larger than the diameter of the optical disk 100*a*, thereby eliminating the need for increasing the size up to the length of the diagonal line of the paper material 100*c*, so that the entirety of the printing apparatus can be miniaturized.

Additionally, before the printing is started, the support tray 5 is ejected to the outside of the apparatus by the eject operation to set the printing object on the support tray 5. At this time, the rotatable base 32 is rotated in the apparatus in advance and placed at a predetermined stop position based on the signals from the rotation position detection switch 50 and the encoder 48, thereafter being moved to the outside of the apparatus.

As a result, even if the rotatable base 32 is rotated by some external forces and detached from the predetermined stop position, it is possible to place the rotatable base 32 at the predetermined stop position by this positioning process at the time when the printing object is set.

(Third Embodiment)

An explanation will be next given of the printing apparatus having the apparatus structure which is appropriate to perform printing to a plurality of printing objects each having a different size.

Figure 18:
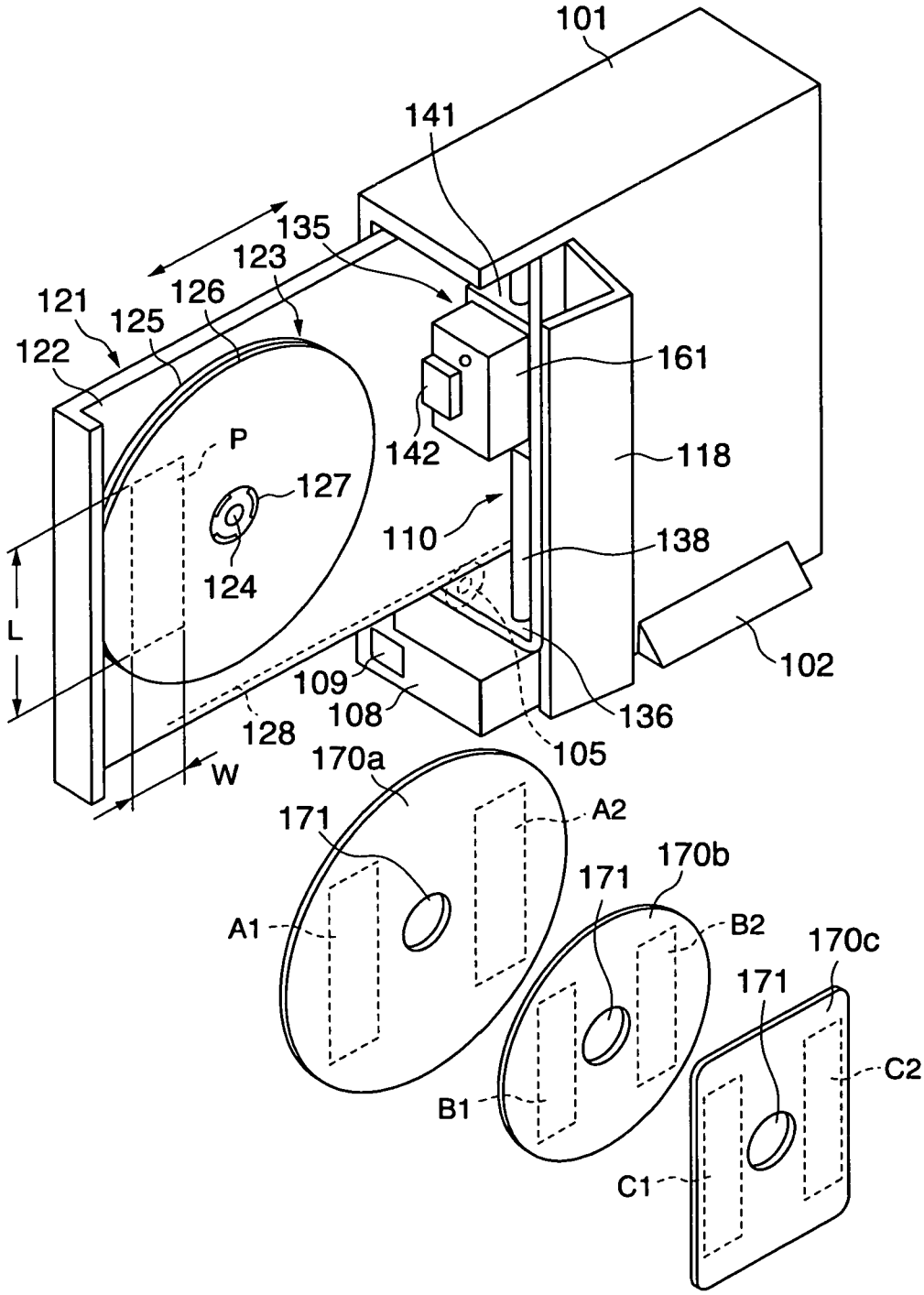
FIG. 18 is a perspective view showing the entirety of a printing apparatus according to a third embodiment of the present invention.
Figure 19:
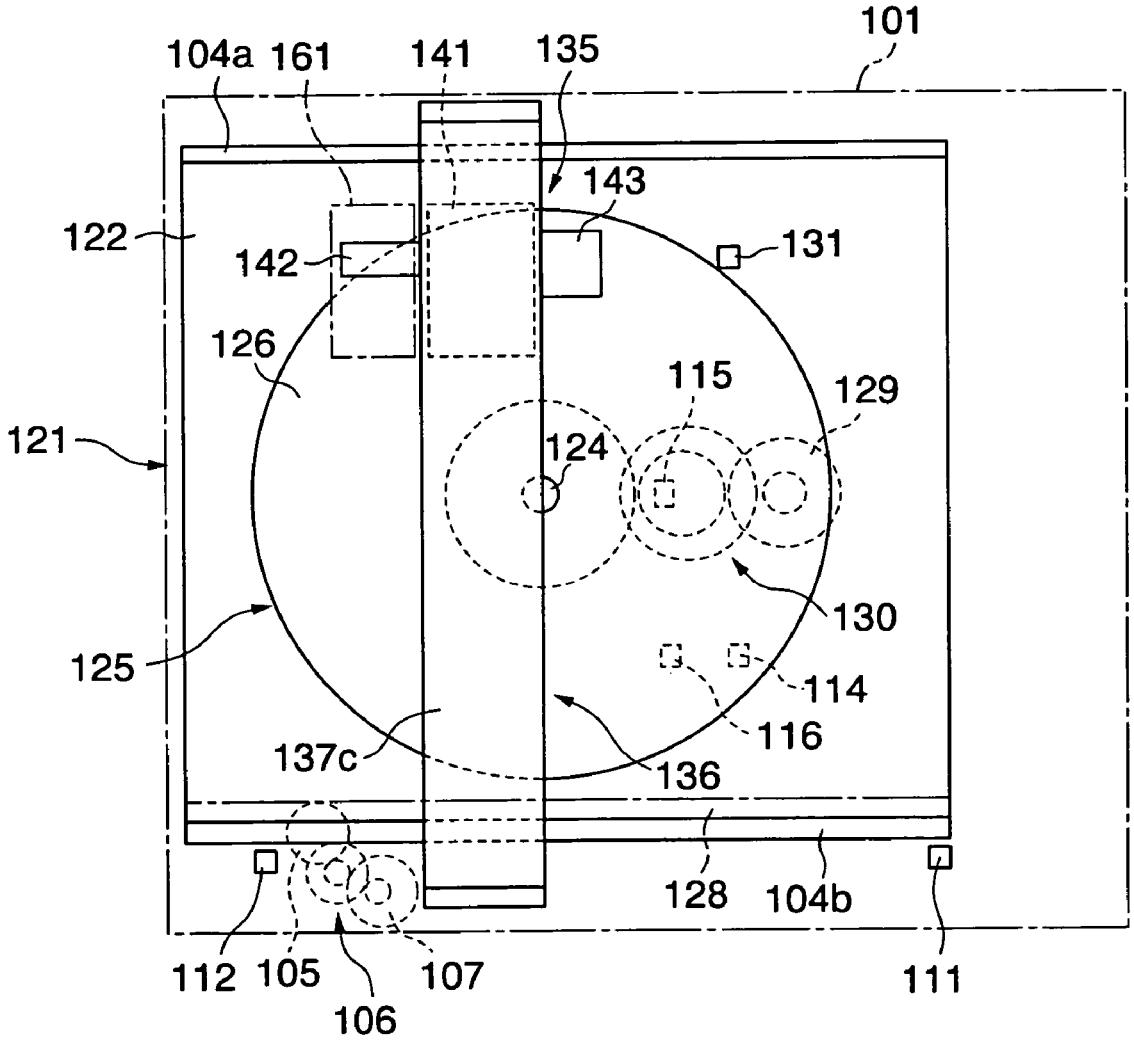
FIG. 19 is a side view showing the structure of the main parts of the printing apparatus of FIG. 18.
Figure 20:
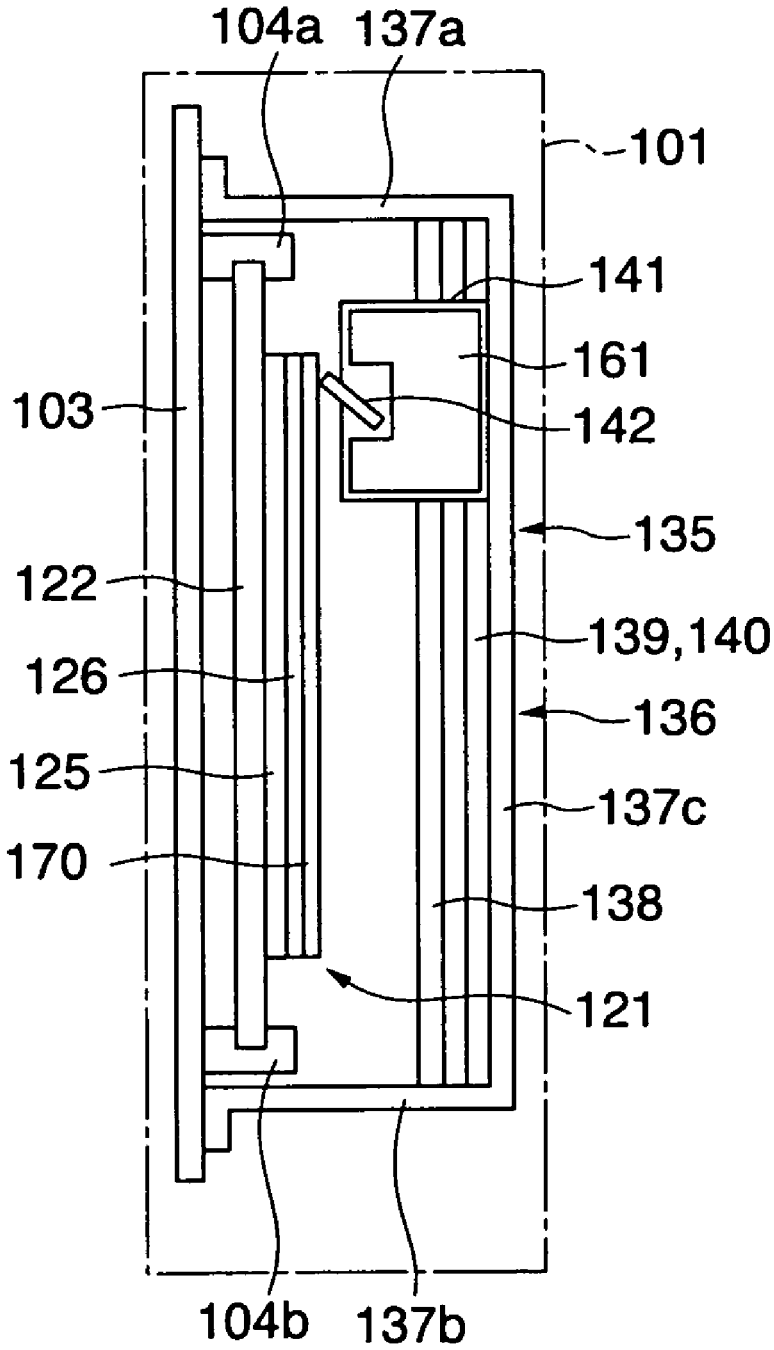
FIG. 20 is a front view showing the structure of the main parts of the printing apparatus of FIG. 18.

FIG. 18 is a perspective view showing the entirety of a printing apparatus according to this embodiment. FIGS. 19 and 20 are a side view and a front view, each showing the structure of the main parts of the printing apparatus.

This printing apparatus includes a box-shape case 101 with the shorter side at the top as an apparatus main body. On both outer side surfaces of the bottom of the case 101, there is formed a leg portion 102 to stabilize placement to an installing surface. The case 101 is installed uprightly on the installing surface with the leg portion 102 at the bottom.

A base 103 is provided in the case 101, and a tray 121, which supports an optical recording medium as a printing object such as CD-R and the like, is formed on the base 103. Moreover, in the case 101, there is provided a printer section 135 that performs printing of title and the like on data recorded on the optical recording medium to the surface (label surface) of the optical recording medium supported by the tray 121.

This printing apparatus is structured such that printing can be performed to a plurality of optical recording media each having a different outer shape and a size. The respective recording media including a CR-R 170*a* with a diameter of 12 cm (hereinafter simply referred to as optical recording medium or large disk), a CR-R 170*b* with a diameter of 8 cm (hereinafter simply referred to as optical recording medium or small disk), and a card-shape CD-R 170*c* (hereinafter simply referred to as optical recording medium or card type) can be attached to the tray 121 and printing can be performed to the respective optical recording media by the printer section 135.

The tray 121 has a rectangular plate-like tray main body 122. At one side surface of the tray main body 122 to be used as a disk support surface 123 that supports the optical recording media 170*a*, 170*b*, and 170*c*, there is provided a rotatable base 125, which is rotatable around a rotating shaft 124 and which supports the optical recording media 170*a*, 170*b*, and 170*c*.

A cushion sheet 126 is adhered to the surface of the rotatable base 125. At the central portion thereof, a plurality of engaging claws 127, which engages with the inner periphery of a circular hole 171 of each of the optical recording media 170*a*, 170*b*, and 170*c*, is formed to be projected from the surface of the rotatable base 125. The engaging claws 127 have a projection height to such a degree that they do not project through the label surface of each of the optical recording media 170*a*, 170*b*, and 170*c*. The optical recording media 170*a*, 170*b*, and 170*c* are held by the rotatable base 125.

The tray 121 is placed in the case 101 in a state that the disk support surface 123 is directed substantially vertically. The tray 121 is guided along guide rails 104*a* and 104*b* provided on the base 103 at upper and lower positions in the case 101 to be movable to the inside and outside of the apparatus.

A rack 128 is provided at the side edge of the lower side of the tray main body 122. In the case 101, there is provided a stepping motor (tray driving motor) 107 that rotates a drive gear 105 forward and reversely through the drive gear 105, which meshes with a rack 128, and a gear train 106. Then, the motor 107 is driven forward by the operation of an eject button 109 provided on a front panel 108 of the case 101, so that the tray 121 placed at a containing position in the apparatus is ejected to the outside of the apparatus from an opening portion 110 formed at the front surface of the case 101. Moreover, the motor 107 is driven reversely by the operation of the eject button 109, so that the tray 121 placed at the outside of the apparatus is moved to the containing position in the apparatus. Furthermore, as explained later, this printing apparatus is structured such that the tray drive motor 107 is driven to move the tray 121 to a predetermined position in the apparatus by control of the control section at a print operating time in order that the position of the print area set to each optical recording medium is made correspond to the printer section 135 in accordance with the kind of the optical recording medium.

Additionally, in the case 101, there is provided a position detection switch 111 that detects that the tray 121 is moved to the containing position in the apparatus. Further, there is provided a position detection switch 112 that detects that the tray 121 is moved to an eject position, which is the outside of the apparatus, where the optical recording medium is attachable and detachable. Based on the signals from these position detection switches 111 and 112, the drive of the motor 107 is controlled, so that the tray 121 is controlled to be stopped at a predetermined stop position in the inside and outside of the case 101. These position detection switches 111 and 112 are actuated by projections for a switch operation (not shown) provided on the tray main body 122.

Moreover, in the case 101, at three portions, there are provided three medium detection switches 114, 115, and 116 that detect the presence or absence of the attachment of the optical recording medium to the tray 121 and the kind of the attached optical recording medium. Each of these switches 114, 115, 116 has an actuator that projects to the rotatable base 125 of the tray 121. When the optical recording medium is placed at the position on the rotatable base 125 corresponding to the position of the relevant switch, the actuator operates by an amount corresponding to the thickness of the optical recording medium to turn on the switch.

Figure 23:
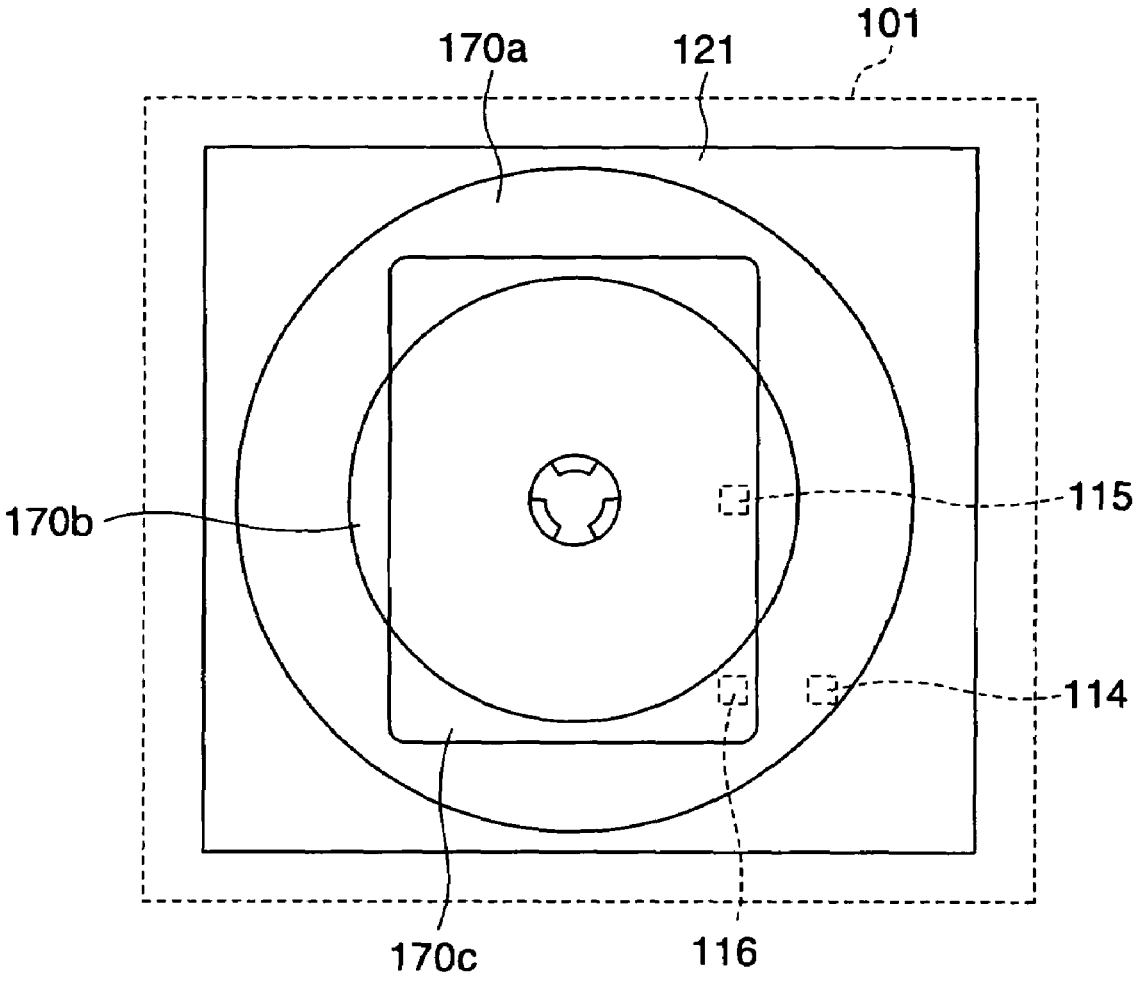
FIG. 23 is a view showing a relationship between the plurality kinds of optical recording media and medium detection switches.

FIG. 23 shows the relationship in the position between three kinds of optical recording media 170*a*, 170*b*, and 170*c* supported by the rotatable base 125 and three medium detection switches 113, 114, 115, respectively. As shown in FIG. 23, when the large disk 170*a* is attached to the tray 121, all switches are turned ON since the positions of three switches 114, 115, 116 correspond to the large disk 170*a*. When the small disk 170*b* is attached to the tray 121, only one switch 115, which corresponds to the small disk 170*b*, is turned ON. When the card type 170*c* is attached thereto, two switches 115 and 116 are turned ON. When there is no recording medium on the tray 121, all switches are turned OFF.

The rotatable base 125 provided on the tray 121 has the rotating shaft 124 at its center, and the rotating shaft 124 is rotatably supported by the tray main body 122 to be rotatable to the tray main body 122. A stepping motor (rotatable base drive motor) 129, which is provided at the back surface side of the disk support surface 123 of the tray main body 122, is used as a drive source and driving force of the motor 129 is transmitted to the rotating shaft 124, so that the rotatable base 125 is driven to be rotated clockwise.

In addition, the tray main body 122 is provided with a rotation position detection switch 131, which detects a rotation angle of the rotatable base 125 to control the drive of the motor 129. The detection switch 131 is actuated by projections for a switch operation (not shown) provided on two portions of the outer periphery of the rotatable base 125 to be opposed 180°. The stop position of the rotatable base 125 can be detected by the actuation of the switch 131.

Moreover, in the case 101, there is provided the printer section 135, which is placed at the disk support surface 123 of the tray 121 to be opposite to the rotatable base 125 and which is composed of a thermal transfer printer.

The printer section 135 includes a bridge-shape printer frame 136. Leg portions 137*a* and 137*b*, which are provided at both end portions of the printer frame 136, are fixed to the base 103 of the case 101. A vertical frame portion 137, which is vertically stretched between the leg portions 137*a* and 137*b*, is placed to be biased to the front side of the case 101 from the rotation center portion of the rotatable base 125.

The printer frame 136 supports a carriage 141 equipped with a thermal head 142 and forms a running path where the carriage 141 is moved back and forth vertically along the rotatable base 125. A guide shaft 138, which guides the carriage 141 slidably, is provided in parallel with a vertical frame portion 137*c*. Moreover, a rack 139 and a guide rail 140 are provided along an opposite face side to the rotatable base 125 of the vertical frame portion 137*c*. The rack 139 meshes with a drive gear 144 provided at the carriage 141 when the carriage 141 runs. The guide rail 140 guides the carriage 141. The carriage 141 is structured in a self-propelling system in which the drive gear 144 is driven by the equipped stepping motor (carriage drive motor) 143 to move back and forth along the rack 139.

A ribbon cartridge 161, which contains an ink ribbon 162 for thermal transfer printing, is attached to the front side of the carriage 141. The ribbon cartridge 161 is replaceable by opening a printer cover 118 provided at the front of the case 101.

Figure 21B:
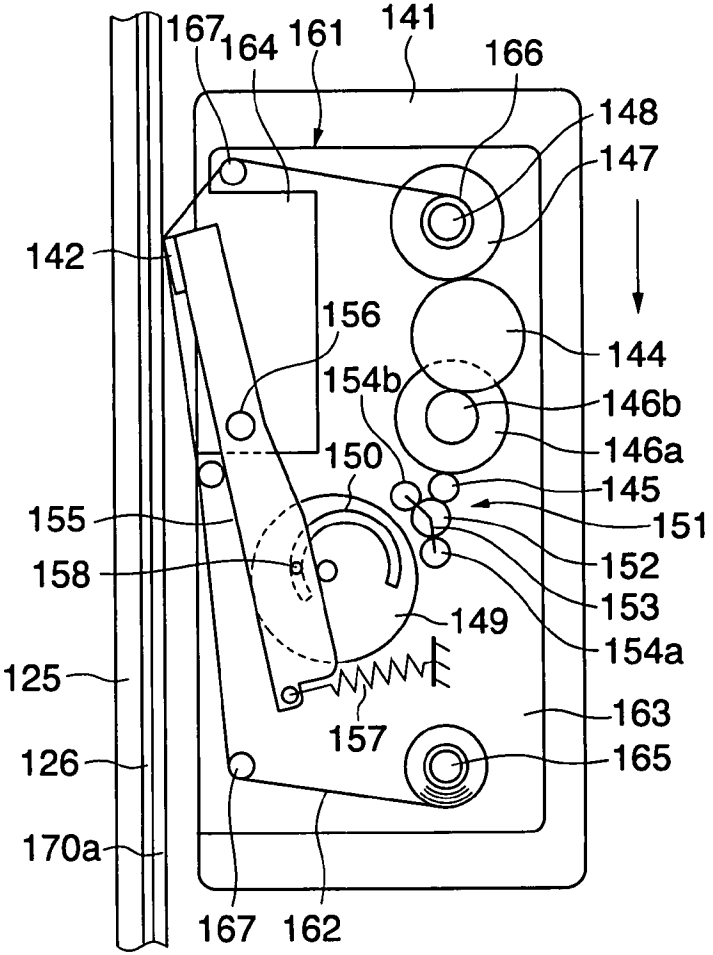
FIGS. 21A and 21B are views each showing the structure of a printer section of the printing apparatus according to the third embodiment of the present invention.
Figure 21A:
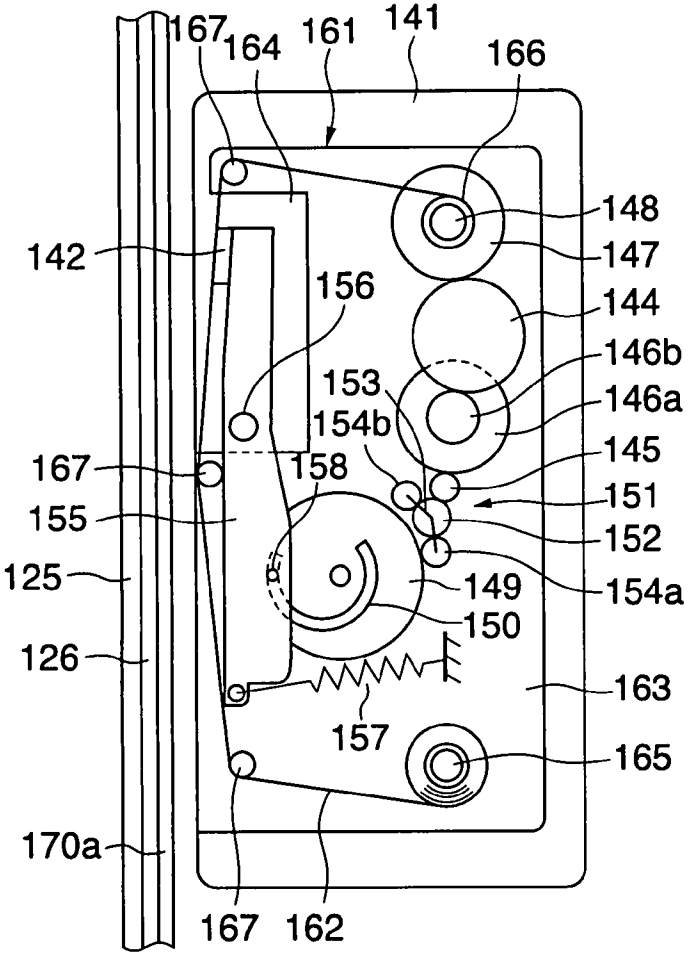

Next, the printer section 135 will be further explained based on FIGS. 21A and FIG. 21B. FIGS. 21A and 21B correspond to FIGS. 16A and 16B explained in the first embodiment, and the printer section 135 of this embodiment has substantially the same structure as the structure of the printer mechanism of the first embodiment. For the convenience of the explanation, different reference numerals are added to the components common to the printer mechanism of the first embodiment. However, the functions and operations are the same. In the explanation set forth below, though some are duplicated, the structure of the printer section 135 is briefly described and the functions and operations of the respective components will be omitted.

The thermal head 142 is provided at the front of the carriage 141. In the carriage 141, there are provided a running drive mechanism of the carriage 141, a head moving mechanism of the thermal head 142, and a winding mechanism of the ink ribbon 162. The stepping motor 143, which is a starting source for these mechanisms and which rotatable forward and reversely, is attached to the back surface of the carriage 141.

The ribbon cartridge 161 includes a case 163. On the case 163, a concave portion 164 to which the thermal head 142 is inserted. In the case 163, a ribbon supply core 165 and a ribbon winding core 166 are provided. The ink ribbon 162 paid out from the ribbon supply core 165 is guided by a plurality of guide pins 167, and is wound around the wind core 166 through the concave portion 164 where the thermal head 142 is positioned.

In the carriage 141, there is provided an output gear 145 attached to an output shaft of the stepping motor 143, and a large-diameter gear 146*a* meshes with the output gear 145. Moreover, a small-diameter gear 146*b* provided coaxially with the large-diameter gear 146*a* meshes with the drive gear 144 that meshes with the rack 139. The drive gear 144 meshes with the ribbon winding gear 147. Moreover, a ribbon winding shaft 148 is provided coaxially with a rotating shaft of the ribbon winding gear 147 through a one-way clutch (not shown). The ribbon winding shaft 148 projects to the front of the carriage 141 to engage with the winding core 166 of the ribbon cartridge 161. In addition, one engaging portion is provided at the opposing surface of each of the large-diameter gear 146*a* and small-diameter gear 146*b* with an equal distance in the radial direction from the shaft. When the motor 143 rotates reversely, there is provided a drive delay mechanism in which when the motor 143 rotates reversely, the large-diameter 146*a* rotates by a predetermined angle and the rotation drive to the small-diameter gear 146*b* from the large-diameter gear 146*a* is not transmitted during the time before the engaging portion of the large-diameter gear 146*a* engages with that of the small-diameter gear 146*b*.

Moreover, a cam gear 149 is provided in the carriage 141. The cam gear 149 is provided with an arc-shape cam groove 150, which is off-centered against the center of the rotation. Then, a swing clutch 151 is formed between the cam gear 149 and the output gear 145.

The swing clutch 151 is composed of a sun gear 152, which meshes with the output gear 145, and a pair of planet gears 154*a* and 154*b*, which mesh with the sun gear 152 and which are supported to be movable in the circumferential direction of the sun gear 152 through an arm 153.

In the carriage 141, there is provided a head arm 155 to which the thermal head 142 is attached to be rotatable around the center of a shaft 156. The head arm 155 is urged anticlockwise by a spring 157 provided at one end side in a tensioned state. Further, the head arm 155 is provided with a pin 158 close to the one end. The pin 158 is slidably inserted to the cam groove 150 of the cam gear 149.

Referring back to FIG. 18, an area P on the rotatable base 125 shown by a broken line indicates a range where when the tray 121 is contained at a predetermined containing position in the case 101, the thermal head 142 moves along the rotatable base 125. The strip range P becomes a print area to the optical recording medium. A width W of the strip range P corresponds to a width of a heating element column of the thermal head 142, and a length L is a distance where the thermal head 142 is movable.

Moreover, in FIG. 18, A1,A2, B1, B2, C1, and C2 show print areas of the optical recording media 170*a*, 170*b*, 170*c* where printing is performed by the printer section 135. The printing apparatus performs title printing by one or twice print operations. For example, in connection with the large disk 170*a*, title printing is performed to the print area A1 by one print operation, or title printing is performed to two portions of the print areas A1 and A2 by twice print operations. The print areas A1 and A2 are symmetrically positioned with a circular hole therebetween. In a case where printing is performed to these two areas, after performing printing to the first area A1, the rotatable base drive motor 129 is driven to rotate the rotatable base 125 180° to make the area A2 correspond to the printer section 135. The rotation drive mechanism of the rotatable base 125 using the rotatable base drive motor 129 as a drive source that places the print position for a second portion to the printer section 135. The relevant rotation drive mechanism is driven before the second printing is started after the end of the first printing, and the operation stops to hold the optical recording medium stationary on the rotatable base 125 during the execution of printing of the printer section 135.

Figure 22A:
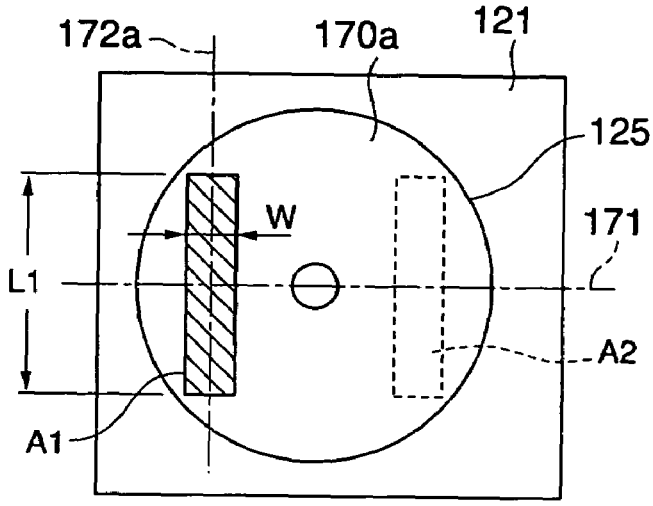
FIGS. 22A, 22B and 22C are views showing print areas of a plurality kinds of optical recording media and each showing a relationship in the position between the print area and the printer section.
Figure 22B:
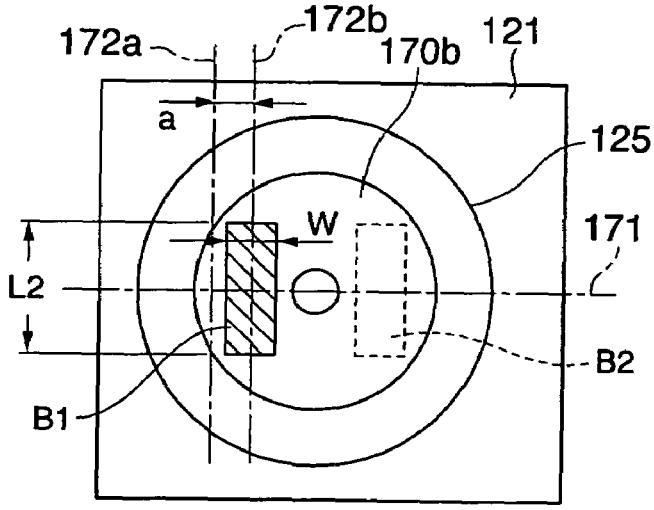
Figure 22C:
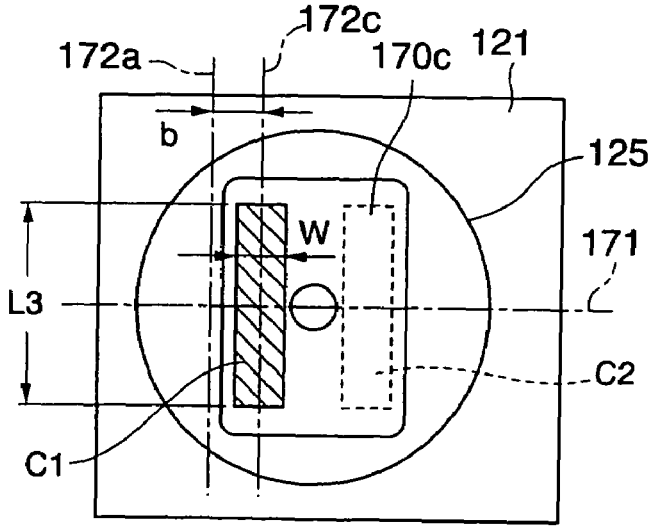

Each of FIGS. 22A, 22B, and 22C shows a relationship in the position between the position of each print area and the printer section 135 when each of the plurality kinds of optical recording media 170*a*, 170*b*, and 170*c* is attached to the tray 121. FIG. 22 show the positions of optical recoding media on the tray 121, respectively when the tray 121 is drawn to the containing position of the innermost side of the apparatus. This position of the tray 121 is the initial position of the tray 121 at the time the printing operation is started by the printing apparatus, and this position can be detected by the position detection switch 111.

As mentioned above, the tray 121 is provided to be movable to the case 101. However, the printer section 135 is provided to be fixed to a predetermined position in the apparatus and the movable range of the thermal head 142 is also fixed to a predetermined position. In FIG. 23, the print area A1 of the large disk 170*a* has a width W and a length L1, the print area B1 of the small disk 170*b* has a width W and a length L2, and the print area C1 of the card type 170*c* has a width Wand a length L3. Each width W of the print areas A1, B1, and C1 is equal to the effective print width W corresponding to the width of the heating element column of the thermal head 142. Regarding the lengths of the respective print areas, L1 is the longest, and L3 and L2 follow in order. The movable distance L of the thermal head 142 is larger than L1. Moreover, in FIG. 22, reference numeral 171 denotes a center line of the tray 121 and a central line of each of the respective optical recording media 170*a* to 170*c* attached to the tray 121 in the moving direction to the case 101. The center line 171 is also a center line of each of the print areas A1, B1 and C1 of the respective optical recording media 170*a* to 170*c* in the length direction. Each of 172*a*, 172*b*, and 172*c* is a center line of each of the respective optical recording media 170*a* to 170*c* in the axial direction, and this center line and the center line 171 of the tray 121 in the moving direction intersect each other at right angles. 172*a* is also a center line of the width (effective print width) of the heat element row of the thermal head 142 moving on the tray 121 in accordance with movement of the carriage 141 at the printing time. Symbols a and b show a distance between the center line 172*a* and the center line 172*b* and a distance between the center line 172*a* and the center line 172*c*, respectively. Here, a is smaller than b.

As shown in FIG. 22, the center line of the print area A1 of the large disk 170*a* in the axial direction coincides with the center line of the heat element row of the thermal head 142 in the axial direction. The printing to the large disk 170*a* is performed when the tray 121 is placed at the predetermined containing position where it is drawn to the innermost side in the apparatus. The center of the small disk 170*b* in the axial direction of the print area B1 is placed at the position, which is separated by distance a to the outside of the apparatus from the center line 172*a*, which is the center of the width of the heat element row of the thermal head 142. Accordingly, the printing is performed at the position where the tray 121 is moved by the corresponding amount to the outside of the apparatus from the containing position. Moreover, the center of the card type 170*c* in the axial direction of the print area C1 is placed at the position, which is separated by distance b to the outside of the apparatus from the center line 172*a* , which is the center of the width of the thermal head 142. Accordingly, the printing is performed at the position where the tray 121 is moved by the corresponding amount to the outside of the apparatus from the containing position.

Furthermore, in FIG. 22, the position where the center line 171 and center line 172*a* intersect each other becomes the home position of the thermal head 142 of the printer section 135. The printer section 135 drives the thermal head 142 to perform printing when the carriage 141 moves from the upper to the lower. Accordingly, the print area A1 has the print start position which is placed upward by L1/2 from the home position, and the print end position, which is placed downward by L1 therefrom. Similarly, the print area B1 has the print start position which is placed upward by L2/2 from the home position, and the print end position, which is placed downward by L2 therefrom. The print area C1 has the print start position which is placed upward by L3/2 from the home position, and the print end position, which is placed downward by L3 therefrom.

Additionally, the print areas A2, B2, and C2 where printing is performed to the respective optical recording media 170*a* to 170*c* by the second print operation are symmetrically positioned with respect to the first print areas A1, B1, C1 and the circular hole 171.

Figure 24:
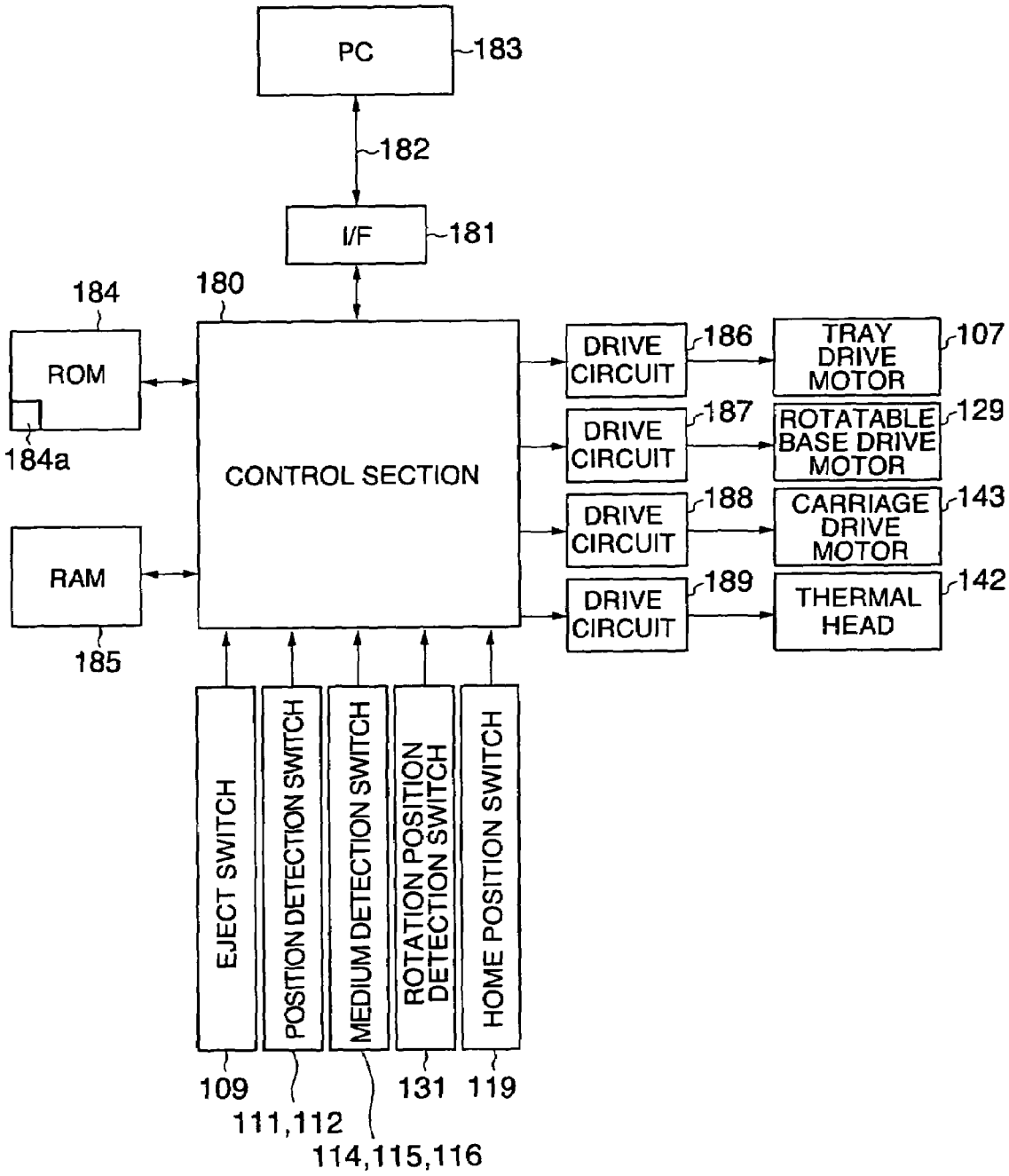
FIG. 24 is a block diagram showing the structure of an electronic circuit of the printing apparatus of FIG. 18.

FIG. 24 shows the structure of an electronic circuit of the printing apparatus according to this embodiment. This printing apparatus includes a control section 180. A personal computer 183 is connected to the control section 180 by an USB cable 182 via an interface (I/F) 180.

The control section 180 includes a ROM 184 and a RAM 185. In the ROM 184, program data such as a system program that controls the operation of each component of the printing apparatus in accordance with a print control signal from the external personal computer 68 is stored. Moreover, in the ROM 184, there is provided a print area position information storing area 184*a* that stores data of the position on the print area set according to the kind of the optical medium. FIG. 25 shows one example of the relevant position data. As shown in the figure, position data is composed of data 1 (data on an amount of tray movement), data 2 (data on an amount of carriage movement from the home position to the print start position) and data 3 (data on an amount of carriage movement from the print start position to the print end position) which correspond to the optical recording media. Moreover, the RAM 185 includes a memory that stores print data sent from the personal computer 183, a counter that counts the number of times of printing, and the like.

Further, the inkjet switch 109, tray position detection switches 111, 112, tray rotation position detection switch 131, medium detection switches 114, 115, 116, and a switch 119 that detects the home position of the carriage 141 are connected to the control section 180, respectively. Output signals of these components are supplied to the control section 180.

Then, the tray drive motor 107, rotatable base drive motor 129, carriage drive motor 143, and thermal head 142 are connected to the control section 180 via a drive circuit 186, a drive circuit 187, a drive circuit 188, and a drive circuit 189, respectively.

Figure 26:
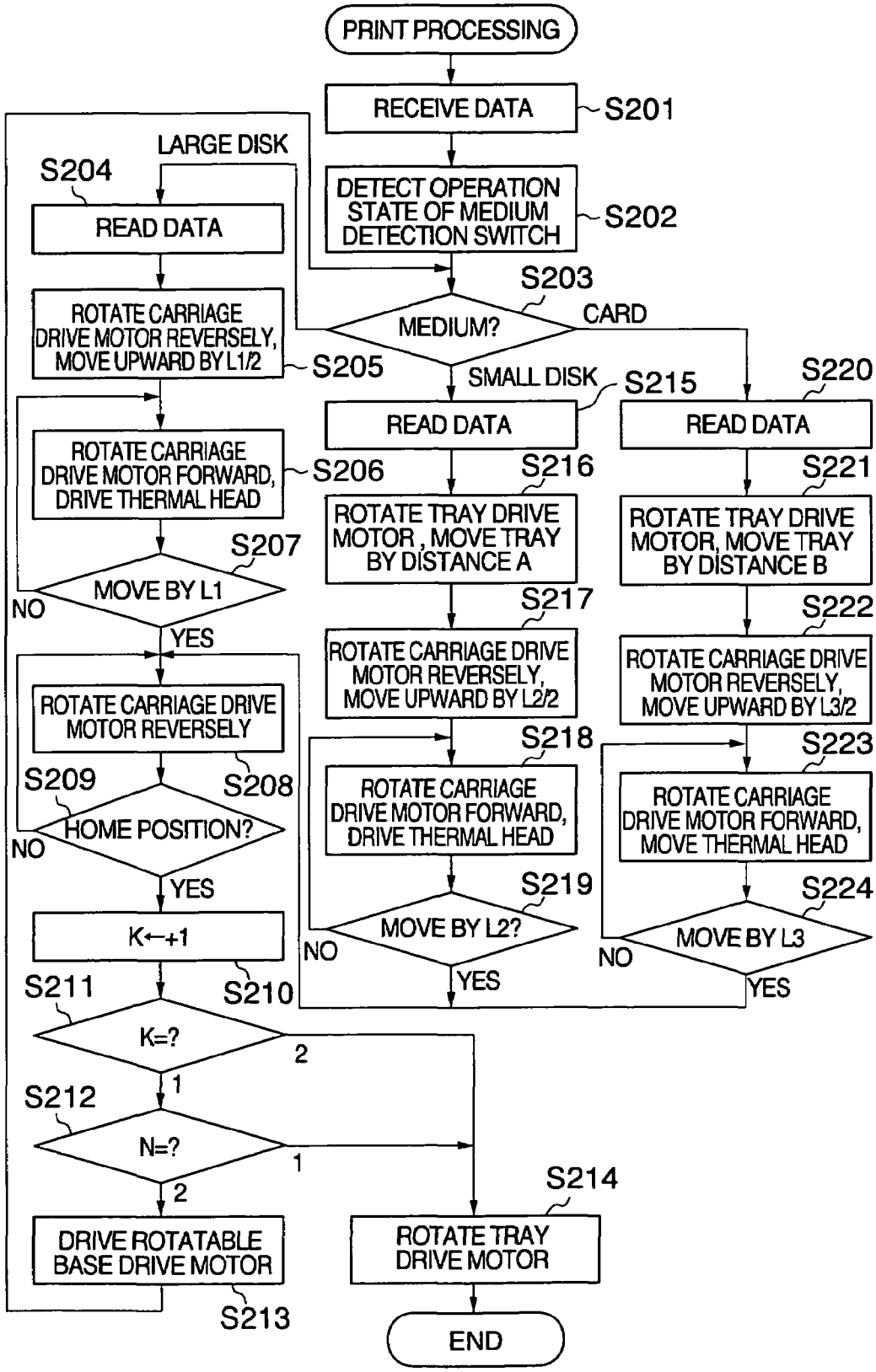
FIG. 26 is a flowchart showing print processing of the printing apparatus according to the third embodiment of the present invention.

FIG. 26 is a flowchart showing print processing of the printing apparatus.

At the time of starting this print processing, the tray 121 on which a print-object optical recording medium is mounted is drawn to the containing position of the innermost side of the apparatus.

Print data to be printed on the label surface of the optical recording medium generated and edited by the personal computer 183, data on the number of print portions, and a print start command are transferred to the printing apparatus, and transferred data is stored to the RAM 185 (step S201).

First, the control section 180 detects the operation states of the medium detection switches 114, 115, and 116, and determines the kind of the optical recording medium attached to the tray 121 based on the detection (steps S202, S203).

When determining that the large disk 170*a* with a diameter of 12 cm is attached to the tray 121, the control section 180 reads data corresponding to the large disk 170*a* from the print area position information storing area 184*a* (step S204). Sequentially, the control section 180 drives the carriage drive motor 143 reversely to move the carriage 141, which has stopped at the home position, to the upper print start position upward by L1/2 (step S205).

After that, when the carriage drive motor 143 is driven forward, the thermal head 142 first moves down and abuts against the label surface of the large disk 170*a*, and movement of the carriage 141 and ink ribbon winding are started later. The control section 180 drives the thermal head 142 in accordance with these operations, and performs printing based on first print data during distance L1 of the downward movement of carriage 141 (steps S206 and S207). When the thermal head 142 moves to the print end position where it has moved by L1 from the print start position and the first printing ends, the control section 180 drives the carriage drive motor 143 reversely. Thereby, the thermal head 142 first moves up from the print operation position. Sequentially, the carriage 141 starts to move upward (steps S207 and S208).

When it is determined that the carriage 142 has returned to the home position (step S209), a counter K, which shows the number of times of printing to be set in the RAM 185, is incremented (step S210). The control section 180 determines a counter value (step S211) and data N of the number of printing portions to be set (step S212). When K is 1 and N is 2, the rotatable base drive motor 129 is driven and the rotatable base 125 rotates 180 (step S213). As a result, an area where second printing should be performed is placed to correspond to the printer section 135.

When the second printing is performed by repeating processing in steps S204 to S209 in the same way as the first printing, the counter K is incremented and the value becomes 2 (steps S210 and S211). Accordingly, the control section 180 drives the tray drive motor 107 forward to eject the tray 121 to the outside of the apparatus, and ends processing (step S214, END).

When it is determined that the value of K is 2 in step S211, all printing to two print portions is ended. When it is determined that the value of K is 1 in step S211, the number of set print portions is one and printing is not yet ended. For this reason, in either case, the control section 180 drives the tray drive motor 107 to eject the tray 212 to the outside of the apparatus and ends processing (step S214, END).

Next, it is determined that the optical recording medium attached to the tray 121 is the small disk 170*b* with a diameter of 8 cm in step S203, the control section 180 reads data, which corresponds to the small disk 170*b*, from the storing area 184*a* the ROM 184 (step S215). The control section 180 drives the tray drive motor 107 forward to move the tray 121 toward the outside of the apparatus by a. The amount of movement of the tray 121 is controlled by the number of drive steps of the tray drive motor 107 (step S216).

Next, the control section 180 drives the carriage drive motor 143 reversely to move the carriage 141, which has stopped at the home position, to the print start position upward by L2/2 (step S217). After that, when the carriage drive motor 143 is driven forward, the thermal head 142 first moves down and abuts against the label surface of the small disk 170*b*, and movement of the carriage 141 and winding of the ink ribbon 161 are started later. The control section 180 drives the thermal head 142 in accordance with these operations, and performs printing based on first print data during distance L2 of the movement of carriage 141 (step S218).

When the thermal head 142 moves to the print end position where it has moved by L2 from the print start position and the first printing ends (step S219), the control section 180 drives the carriage drive motor 143 reversely to return the carriage 141 to the home position (steps S208 and S209). At the same time, the control section 180 counts the number of times of printing using the printing number counter K and checks the number of set print portions (steps S210, S211, and S212). When the second printing is not yet finished, the control section 180 rotates the rotatable base 125 by 180° to position the second print area to the printer section 135 (step S213), and returns to step S203 to perform the second print processing in the same way as the first print processing.

Then, when the second printing is performed by repeating processes of steps S215 to S219 and steps S208 to S209, the counter K is incremented and the value shown by the counter K becomes 2 (steps S210, and S211). Then, the control section 180 drives the tray drive motor 107 to eject the tray 121 to the outside of the apparatus and finishes the process (step S214, END).

In the case where it is determined in step S211 that the value of K is 2, it means that the printing operations to all of the two print positions have been finished. Further, in the case where it is determined in step S212 that the value of N is 1, this means that the set number of print positions is 1, and the printing operation to the one print position has been finished. Therefore, in both of the cases, the control section 180 drives the tray drive motor 107 to eject the tray 121 to the outside of the apparatus, and ends the process (step S214, END).

Next, it is determined that the optical recording medium attached to the tray 121 is the card type 170*c* in step S203, the control section 180 reads data, which corresponds to the card type 170*c*, from the storing area 184*a* of the ROM 184 (step S220). The control section 180 drives the tray drive motor 107 forward to move the tray 121 toward the outside of the apparatus by b (step S221).

Next, the control section 180 drives the carriage drive motor 143 reversely to move the carriage 141, which has stopped at the home position, to the print start position upward by L3/2 (step S222). After that, when the carriage drive motor 143 is driven forward, the thermal head 142 first moves down and abuts against the label surface of the card type 170*c*, and movement of the carriage 141 and winding of the ink ribbon 162 are started later. The control section 180 drives the thermal head 142 in accordance with these operations, and performs printing based on first print data during distance L3 of the downward movement of carriage 141 (step S223).

When the thermal head 142 moves to the print end position where it has moved by L3 from the print start position and the first printing ends (step S224), the control section 180 drives the carriage drive motor 143 reversely to return the carriage 141 to the home position (steps S208 and S209). At the same time, the control section 180 counts the number of times of printing using the printing number counter K and checks the number of set print portions (steps S210, S211, and S212). When the second printing is not yet finished, the control section 180 rotates the rotatable base 125 by 180° to position the second print area to the printer section 135 (step S213), and returns to step S203 to perform the second print processing in the same way as the first print processing.

Then, when the second printing is performed by repeating processes of steps S215 to S219 and steps S208 to S209, the counter K is incremented and the value shown by the counter K becomes 2 (steps S210, and S211). Then, the control section 180 drives the tray drive motor 107 to eject the tray 121 to the outside of the apparatus and finishes the process (step S214, END).

In the case where it is determined in step S211 that the value of K is 2, it means that the printing operations to all of the two print positions have been finished. Further, in the case where it is determined in step S212 that the value of N is 1, this means that the set number of print positions is 1, and the printing operation to the one print position has been finished. Therefore, in both of the cases, the control section 180 drives the tray drive motor 107 to eject the tray 121 to the outside of the apparatus, and ends the process (step S214, END).

As explained above, according to the printing apparatus of this embodiment, the print area can be set to be appropriate to each of the large disk 170*a*, small disk 170*b*, and card type 170*c* each having a different size to perform printing in the print area, so that title printing with good balance can be performed.

(Fourth Embodiment)

In the aforementioned printing apparatus according to the third embodiment, in accordance with the position of the print area set to the plurality of kinds of recording media, the tray 121 was moved against the printer section 135 having the thermal heat at the predetermined position of the case 101 to be movable back and forth, so that printing was performed to each print area. However, the tray 121 is fixed to a predetermined containing position in the apparatus, and the printer section 135 is moved against the tray 121 by the same distance as the case of the third embodiment according to the kind of the optical recording medium, thereby the printer 135 may be positioned to the print area of each optical recording medium.

Figure 27:
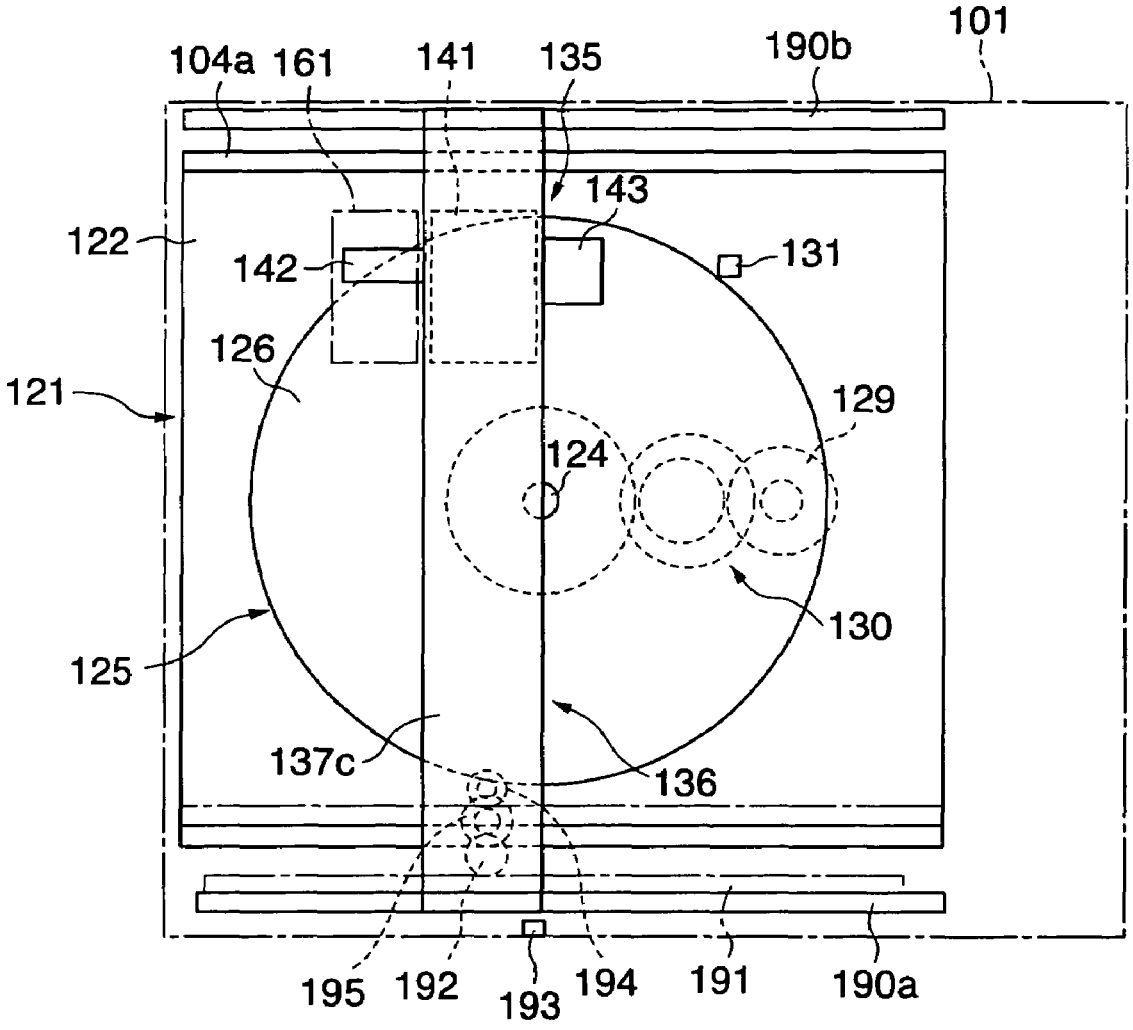
FIG. 27 is a side view showing the structure of the main parts of a printing apparatus according to a fourth embodiment of the present invention.

FIG. 27 shows the printing apparatus according to the fourth embodiment. In this printing apparatus, the leg portion, which forms the frame 136 of the printer section 135, can run on running rails 190*a* and 190*b* provided on the base 103. In the case 101, a rack 191 is provided along the running rails 190*a* and 190*b*. Moreover, in the printer section 135, there is provided a moving mechanism including a printer section moving motor 194, a gear train 195, which transmits rotation of the moving motor 194 to the drive gear, and a drive gear 192, which engages with the rack 191, in order that the frame 136 is movable in the case 101. Moreover, a position detection switch 135 for the printer section 135 is provided to detect the position of the printer section 135 when it is placed at the same position as the case of third embodiment.

In this printing apparatus, information on the position of the print area shown in FIG. 25 is held, and the control section 180 performs control of moving the position of the printer section 135 based on the information and the output from the position detection switch 193. Additionally, in FIG. 27, moving mechanism of the tray 121 is omitted, and the same reference numerals as those of the third embodiment are added to the same components as those of the third embodiment.

The present invention is not limited to the aforementioned embodiments, and applications and modifications may be arbitrarily possible.

For example, the first embodiment explained the example in which the recording medium as the printing object was the optical disk. However, the recording medium as a printing object is not limited to the optical disk, and any recording medium may be possible. For example, it is possible to use a magnetic disk such as a flexible disk, and the like, an optical magnetic disk such as an MO disk, and the like, and optical recording media such as MD, CD-ROM, CD-RW, DVD-ROM, DVD-R, DVD-RAM, DVD-RW, DVD+RW, and the like in addition to CD-R shown as an example of the optical disk.

In the aforementioned embodiments, it has been explained that the program for executing each operation is stored in the ROMs 72 and 184 of the printing apparatus. However, a recording medium for the program is not limited to these but is arbitrary. For example, other recording media such as an IC card and a memory card may be used. Further, the program may be stored in the hard disk of the personal computers 68 and 183 or in a floppy disk, a CD-ROM, a DVD-ROM, etc. which are recording media for external storage devices, so that the printing apparatus may be controlled via the personal computers 68 and 183. Or, the program may be carried on a carrier wave which can be run on a computer, to be provided to the personal computers 68 and 183, so that the printing apparatus may be controlled.

In the aforementioned embodiments, the plurality of convex portions 38 are formed on the lower surface of the rotatable base 32 and the concave portions 39, which correspond to the convex portions 38, are formed on the support tray 5. However, the structure may be made the other way around. Namely, the plurality of concave portions may be formed on the lower surface of the rotatable base 32 and the convex portions, which correspond to the concave portions, may be formed on the support tray 5.

In the aforementioned embodiments, the friction sheet 40 is adhered to the lower surface of the rotatable base 32. However, the friction sheet 40 may be adhered to the upper surface of the support tray 5.

Figure 15:
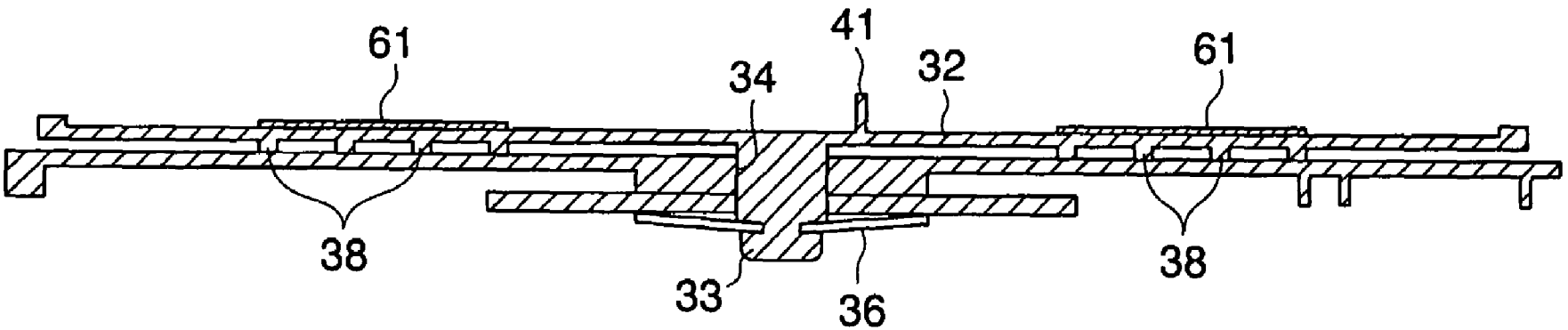
FIG. 15 is a cross-sectional view showing a modification of the support tray and rotatable plate in the printing apparatus of FIG. 1.

In the aforementioned embodiments, the plurality of convex portion 38 may be formed on the portion, which is the lower surface of the rotatable base 32 and which is subjected to pressure by the thermal head 58 as shown in FIG. 15. Moreover, a case in which the convex portions 38 are formed on the upper surface of the support tray 5 may be possible.

In the aforementioned embodiments, the printer section was explained as the thermal transfer printer. However, the type of the printer is not limited to this. For example, this may be configured by the ink jet printer.

The aforementioned embodiments explained the tray 121 or thermal head 142 was moved. However, the print area may be covered by another apparatus configuration. For example, the print head, which has numerous heating elements in the range that covers all print areas A1, B1, and C1 shown in FIG. 22, is provided to be fixed to the case 101. Then, at the printing time, the print elements of the print head may be driven to perform printing in the range corresponding to the print area of the optical recording medium on the tray 121 based on the medium kind detection information from the medium detection switches 14, 15, and 16 in a state that the positions of the printing head and the tray 121 are maintained fixed regardless of the kind of the optical recording medium.

Various embodiments and changes may be made thereunto without departing from the broad spirit and scope of the invention. The above-described embodiments are intended to illustrate the present invention, not to limit the scope of the present invention. The scope of the present invention is shown by the attached claims rather than the embodiments. Various modifications made within the meaning of an equivalent of the claims of the invention and within the claims are to be regarded to be in the scope of the present invention.

This application is based on Japanese Patent Application No. 2002-127123 filed on Apr. 26, 2002 and Japanese Patent Application No. 2002-189724 filed on Jun. 28, 2002 and including specification, claims, drawings and summary. The disclosure of the above Japanese Patent Applications is incorporated herein by reference in its entirety.

INDUSTRIAL APPLICABILITY

As explained above, according to the present invention, it is possible to provide a printing apparatus and a printing method capable of performing printing to a plurality of portions on a surface of a printing object efficiently with a simple apparatus configuration.

Moreover, according to the present invention, it is possible to provide a printing apparatus manufacturable with a small-sized power supply without need of complicated print control and a printing method.

Still moreover, according to the present invention, it is possible to provide a printing apparatus and a printing method applicable to a plurality of kinds of printing objects each having a different size with a simple apparatus configuration.

The invention claimed is:

1. A printing apparatus comprising:

support means, including a rotatable base, for supporting a data recordable recording medium to be mounted on said rotatable base;

rotation drive means for driving said rotatable base to be rotated;

print means, including a print head that is movable within a predetermined range outside of a rotation center of the rotatable base, for performing printing to a predetermined portion on the recording medium supported by said support means while pressing against the recording medium;

a cushion member including a plurality of portions which are positioned outside of the rotation center of the rotatable base, each of which has a shape corresponding to the predetermined range in which the print head is movable so as to cushion the recording medium in the predetermined range in which the print head is movable;

means for detecting a rotation angle of the rotatable base; and control means for said rotation drive means and said print means;

wherein said control means, based on information provided by said means for detecting the rotation angle of the rotatable base, controls the rotation drive means to position one of the portions of the cushion member at a position corresponding to the predetermined range in which the print head is movable, and wherein the control means operates said print means, then operates said rotation drive means based on information provided by said means for detecting the rotation angle of the rotatable base such that another of the portions of the cushion member is positioned at a position corresponding to the predetermined range in which the print head is movable, and thereafter further operates said print means, thereby performing printing to a plurality of portions at different positions of the recording medium supported by said support means.

2. The printing apparatus according to claim 1, wherein:

said support means includes a support base, which supports said rotatable base to be rotatable around a rotation shaft, and urging means for urging said rotatable base to said support base, and a first one of opposing surfaces of said support base and said rotatable base includes convex portions around said rotation shaft, which project from said first opposing surface and which slide in contact with a second opposing surface opposed to said first opposing surface during rotation of said rotatable base by said rotation drive means, and said second opposing surface includes concave portions around said rotation shaft, into which said convex portions are fitted during printing by said print means.

3. The printing apparatus according to claim 2, wherein at least one of the opposing surfaces of the support base and said rotatable base includes a member which has a thickness smaller than a projection height of said convex portion, and which has a cushion property and a friction property.

4. The printing apparatus according to claim 1, wherein:

said support means is movable to a position where the recording medium is attached/detached to/from said rotatable base and to a position where printing is performed by said print means to the recording medium supported by said rotatable base, either one of opposing surfaces of said support base and said rotatable base opposing to each other includes convex portions, which project from said one opposing surface and which abut against another opposing surface opposing to said one opposing surface, at a portion subjected to pressure by said print head.

5. The printing apparatus according to claim 1, wherein a rotating direction of said rotatable base driven to be rotated by said rotation drive means and a moving direction of said print head are opposite to each other at a print portion.

6. The printing apparatus according to claim 5, wherein said rotation drive means includes a drive motor and a gear train having a worm gear that transmits power of the drive motor to said rotatable base.

7. The printing apparatus of claim 1, wherein the rotatable base comprises engaging means, provided on a surface where the recording medium is mounted, for engaging with the recording medium.

* * * * *